US009668058B2

(12) United States Patent
Matsumura et al.

(10) Patent No.: US 9,668,058 B2
(45) Date of Patent: May 30, 2017

(54) SPEAKER DIAPHRAGM, SPEAKER, DEVICE, AND METHOD FOR MANUFACTURING SPEAKER DIAPHRAGM

(71) Applicant: Panasonic Intellectual Property Management Co., Ltd., Osaka (JP)

(72) Inventors: Toshiyuki Matsumura, Osaka (JP); Shuji Saiki, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 56 days.

(21) Appl. No.: 14/790,058

(22) Filed: Jul. 2, 2015

(65) Prior Publication Data

US 2016/0014522 A1 Jan. 14, 2016

(30) Foreign Application Priority Data

Jul. 9, 2014 (JP) ..... 2014-141556
Jul. 9, 2014 (JP) ..... 2014-141557
Mar. 13, 2015 (JP) ..... 2015-050974

(51) Int. Cl.
*H04R 7/18* (2006.01)
*H04R 31/00* (2006.01)

(52) U.S. Cl.
CPC ..... *H04R 7/18* (2013.01); *H04R 31/003* (2013.01); *H04R 2307/204* (2013.01); *H04R 2307/207* (2013.01); *H04R 2499/11* (2013.01); *H04R 2499/13* (2013.01)

(58) Field of Classification Search
CPC ... H04R 7/18; H04R 7/20; H04R 7/04; H04R 31/003; H04R 2307/207; H04R 2499/11; H04R 2499/13
USPC ..... 381/189, 398, 431
See application file for complete search history.

(56) References Cited

U.S. PATENT DOCUMENTS 4,433,214 A * 2/1984 Jasinski ..... H04R 7/20 181/172
2003/0048919 A1* 3/2003 Lin ..... H04R 7/22 381/398
2004/0188175 A1* 9/2004 Sahyoun ..... H04R 7/122 181/157

FOREIGN PATENT DOCUMENTS

JP 6-105393 4/1994
JP 7-023497 1/1995

* cited by examiner

*Primary Examiner* — Jesse A Elbin
(74) *Attorney, Agent, or Firm* — Greenblum & Bernstein, P.L.C.

(57) ABSTRACT

A speaker diaphragm includes: a vibrator; and a suspension adhered to an outer peripheral part of the vibrator and supporting the vibrator so that the vibrator can vibrate, at least part of the suspension including a top surface member constituting a top surface part of the suspension, a rear surface member constituting a rear surface part of the suspension, and an intermediate member between the top surface member and the rear surface member, these members being stacked, the intermediate member having a rigidity lower than that of at least one of the top surface member and the rear surface member, the top surface member having one or more first holes, the rear surface member having one or more second holes, and at least some of the first holes and second holes being dispose so as to overlap across the intermediate member in a direction in which the members are stacked.

33 Claims, 19 Drawing Sheets

SPEAKER DIAPHRAGM, SPEAKER, DEVICE, AND METHOD FOR MANUFACTURING SPEAKER DIAPHRAGM

BACKGROUND

1. Technical Field

The present disclosure relates to a speaker diaphragm, a speaker including a speaker diaphragm, a device including a speaker, and a method for manufacturing a speaker diaphragm. More specifically, the speaker and the device of the present disclosure relate to a small speaker that is capable of reproducing broadband sound, a video audio device including the speaker (a video display appliance, an audio appliance, an in-ear headphone, a home electrical appliance, and the like), a mobile information processing device (a mobile phone, a smartphone, a tablet PC, an operation terminal, and the like), and a moving device (an automobile, a railroad, and the like).

2. Description of the Related Art

In recent years, video audio devices, so-called audio-visual equipment, are rapidly becoming smaller and their functions are rapidly becoming more complex. This trend is marked especially in mobile phones, smartphones, tablet PC (personal computer) terminals, and the like. Since downsizing and complexity of functions are progressing at the same time, mounted devices are required to be smaller and smaller in size and thickness. A speaker mounted in each appliance is no exception and is required to have a smaller size and smaller thickness while maintaining or improving performance as well as other devices. Therefore, there is a demand for a small speaker that is capable of reproducing sound having a high sound pressure level.

In general, a speaker has a vibrator. The vibrator is vibrated by supplying an electrical signal to a voice coil in a case where the speaker is an electrodynamic speaker or to a piezoelectric element in a case where the speaker is a piezoelectric speaker. This generates a compressional wave in the air. In this way, the speaker reproduces sound. A diaphragm of the speaker is constituted by this vibrator and a suspension that supports an outer peripheral part of the vibrator. The suspension has two functions, i.e., a "supporting" function for supporting the vibrator so that the vibrator is capable of smoothly vibrating and an "antiphase sound suppressing" function for preventing antiphase sound that occurs on the back side of the diaphragm from going around to the front side of the diaphragm and canceling reproduced sound.

In order for a small speaker to reproduce sound of a high sound pressure level, the area of a vibrator needs to be large so that a large volume of air is moved. However, the width of a suspension located on the outer peripheral part of the vibrator needs to be made small in order to increase the area of the vibrator without changing the external shape of the diaphragm. A reduction in the width of the suspension causes an increase in the rigidity of vibrator supporting force. This makes it difficult to reproduce low pitch sound. Since the linearity of the vibrator supporting force deteriorates, the harmonic distortion of reproduced sound increases. Therefore, a suspension of a small speaker is required to have low vibrator supporting rigidity and good linearity of supporting force with respect to the amplitude of the vibrator even if the width of the suspension is small.

In view of this, there is a conventional art for reducing harmonic distortion during reproduction with a speaker by providing slit-like holes in a suspension that supports a vibrator. For example, see Japanese Unexamined Patent Application Publication No. 7-023497. FIG. 14 is a diagram for explaining a diaphragm of a conventional speaker described in Japanese Unexamined Patent Application Publication No. 7-023497.

In FIG. 14, a vibrator 101 is supported by a suspension 102, and the suspension 102 is provided with a plurality of slit-like holes 103. When the vibrator 101 vibrates, stretching contracting force works in the circumferential direction of the edge. This deforms, specifically, widens and narrows the slit-like holes 103 provided in the suspension 102. The deformation allows the suspension 102 to be smoothly deformed in the circumferential direction of the suspension 102. This improves the linearity of the force for supporting the vibrator 101. As a result, it is possible to reduce harmonic distortion of sound reproduced by a speaker using this vibrator 101. Furthermore, easy stretching and contraction in the circumferential direction allows the suspension 102 to be deformed smoothly, thereby reducing the supporting force in a vibration direction of the vibrator 101. This makes it possible to realize a small speaker that is capable of reproducing low pitch sound.

Furthermore, there is a conventional art having a structure such that a plurality of divided sides are connected by a cushion material so as to constitute a suspension (see, for example, Japanese Unexamined Patent Application Publication No. 6-105393). FIGS. 15A and 15B are diagrams for explaining a diaphragm of a conventional speaker described in Japanese Unexamined Patent Application Publication No. 6-105393.

According to the arrangement of FIGS. 15A and 15B, the suspension is constituted by a plurality of divided sides 102*a* and 102*b* in order to improve the symmetry of an air exclusion amount of the suspension during vibration of the vibrator 101, and a cushion material 104 is provided over a slit-like hole 103 provided between the divided sides 102*a* and 102*b*. This makes it possible to prevent antiphase sound from the back side of the vibrator 101 from going around to the front side of the vibrator 101.

SUMMARY

In one general aspect, the techniques disclosed here feature a speaker diaphragm including: a vibrator; and a suspension that is adhered to an outer peripheral part of the vibrator and supports the vibrator so that the vibrator is capable of vibrating, wherein at least part of the suspension includes a top surface member that constitutes a top surface part of the suspension, a rear surface member that constitutes a rear surface part of the suspension, and an intermediate member disposed between the top surface member and the rear surface member, the top surface member, the rear surface member, and the intermediate member being stacked on one another, the rigidity of the intermediate member is lower than that of at least one of the top surface member and the rear surface member, the top surface member has one or more first holes, the rear surface member has one or more second holes, and at least some of the one or more first holes and the one or more second holes are disposed so as to overlap each other across the intermediate member in a direction in which the top surface member, the rear surface member, and the intermediate member are stacked.

According to this arrangement, the first holes and the second holes provided in the top surface member and the rear surface member respectively open and close when the vibrator vibrates. This allows the top surface member and the rear surface member that constitute the suspension to smoothly stretch and contract in a circumferential direction.

The intermediate member is designed to have a rigidity lower than that of the top surface member and the rear surface member to an extent such that opening and closing of the holes are not inhibited. As a result, linearity of the suspension improves. Furthermore, since the suspension smoothly moves due to opening and closing of the holes, it is possible to reduce the supporting force of the suspension in the amplitude direction of the vibrator. It is therefore possible to realize a speaker diaphragm that is capable of reproducing low pitch sound without changing the size of the speaker diaphragm. Furthermore, the intermediate member prevents antiphase sound occurring on the back side of the diaphragm during driving of the speaker from going around to the front side of the diaphragm. That is, it is possible to avoid the conventional problem in that reproduced sound is canceled out by antiphase sound from the back side of the diaphragm.

According to the speaker diaphragm of the present disclosure, the vibrator can vibrate flexibly and smoothly, and it is possible to prevent reproduced sound from being canceled out by antiphase sound that occurs from the back side of the diaphragm and goes around to the front side of the diaphragm. It is therefore possible to realize a speaker that is excellent in terms of characteristics of reproducing low pitch sound with low distortion.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1A:
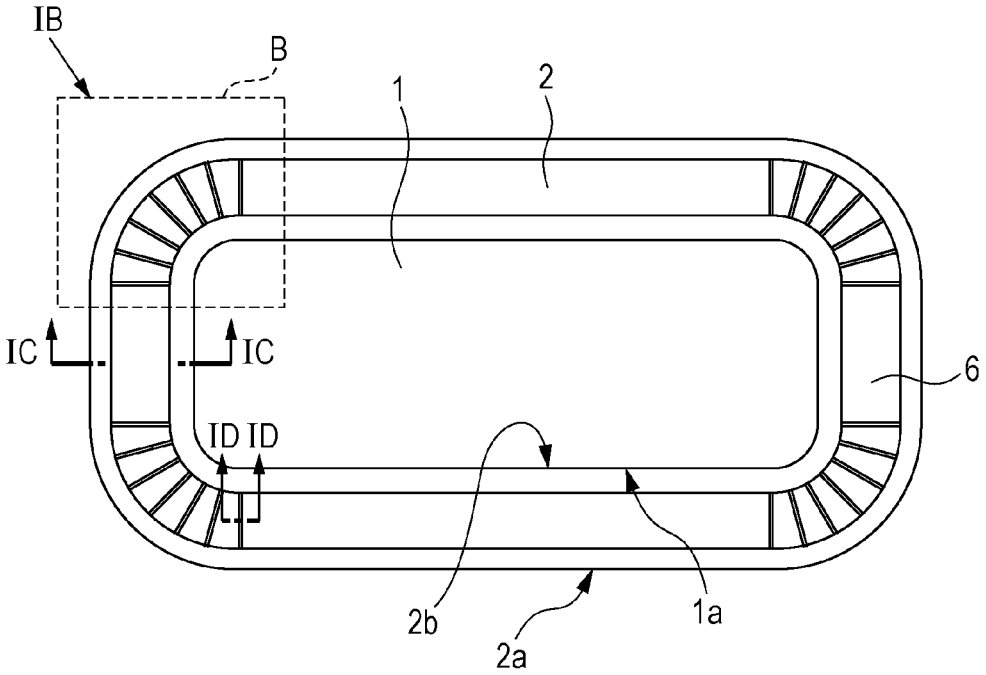
FIG. 1A is a top view of a speaker diaphragm according to the present embodiment.

First, matters which the inventors of the present invention considered in accomplishing the aspects according to the present disclosure are described.

Underlying Knowledge Forming Basis of Present Disclosure

The conventional arrangement described in Japanese Unexamined Patent Application Publication No. 7-023497 has a problem in that antiphase sound from the back side of the vibrator 101 goes around to the front side of the vibrator 101 through the slit-like holes 103 during reproduction using a diaphragm including the vibrator 101 and cancels out sound from the front side of the vibrator 101, resulting in a decrease in sound pressure level. Especially low pitch sound having a long wavelength is easily canceled out, and therefore reproduction of low pitch sound using a speaker is difficult. Furthermore, friction sound of the air passing through the slit-like holes 103 sometimes increases distortion sound.

In view of this, the conventional arrangement described in Japanese Unexamined Patent Application Publication No. 6-105393 makes it possible to prevent antiphase sound from the back side of the vibrator 101 from going around to the front side of the vibrator 101. However, there is a problem in that a large force is applied to parts where the cushion material 104 and the divided parts 102*a* and 102*b* of the suspension are adhered to each other and thereby causes the cushion material 104 to be detached. When the cushion material 104 is detached, antiphase sound leaks from a portion where the cushion material 104 is detached, and reproduction of low pitch sound becomes difficult. Meanwhile, in a case where the adhesion area is increased in order to prevent detachment of the cushion material 104, flexibility of the divided parts 102*a* and 102*b* of the suspension is sacrificed.

The present disclosure was accomplished in order to solve the above conventional problems, and an object of the present disclosure is to provide a speaker diaphragm having a suspension that enables a vibrator to flexibly and smoothly vibrate and prevents antiphase sound occurring on the back side of the vibrator from going around to the front side of the vibrator, a speaker using the speaker diaphragm, and a device in which the speaker is mounted.

Embodiments are described below with reference to the drawings.

Each of the embodiments described below illustrates a preferable specific example of the present disclosure. Numerical values, shapes, materials, constituent elements, positions of the constituent elements, connection forms of the constituent elements, steps, the order of steps, and the like are examples and do not limit the present disclosure. Note that identical elements are given identical reference signs and description of such identical elements may be omitted. Furthermore, matters described in the embodiments described below can be combined.

A first aspect of the present disclosure is a speaker diaphragm including: a vibrator; and a suspension that is adhered to an outer peripheral part of the vibrator and supports the vibrator so that the vibrator is capable of vibrating, wherein at least part of the suspension includes a top surface member that constitutes a top surface part of the suspension, a rear surface member that constitutes a rear surface part of the suspension, and an intermediate member disposed between the top surface member and the rear surface member, the top surface member, the rear surface member, and the intermediate member being stacked on one another, the rigidity of the intermediate member is lower than that of at least one of the top surface member and the rear surface member, the top surface member has one or more first holes, the rear surface member has one or more second holes, and at least some of the one or more first holes and the one or more second holes are disposed so as to overlap each other across the intermediate member in a direction in which the top surface member, the rear surface member, and the intermediate member are stacked.

A speaker may be realized by using the speaker diaphragm of the first aspect, and a device may be realized by using this speaker.

According to this arrangement, the first holes and the second holes provided in the top surface member and the rear surface member respectively open and close when the vibrator vibrates. This allows the top surface member and the rear surface member that constitute the suspension to smoothly stretch and contract in a circumferential direction. The intermediate member is designed to have a rigidity lower than that of the top surface member and the rear surface member to an extent such that opening and closing of the holes are not inhibited. As a result, the linearity of the suspension improves. Furthermore, since the suspension smoothly moves due to opening and closing of the holes, it is possible to reduce the supporting force of the suspension in the amplitude direction of the vibrator. It is therefore possible to realize a speaker diaphragm that is capable of reproducing low pitch sound without changing the size of the speaker diaphragm.

In this aspect, the speaker diaphragm may be arranged to further include a sealing member that covers at least one of (i) the one or more first holes and (ii) the one or more second holes, the rigidity of the sealing member being lower than that of the intermediate member.

According to this arrangement, it is possible to obtain an effect of reinforcing the intermediate member by using the sealing member against acoustic compliance that occurs, for example, in a case where the speaker is mounted on a cabinet.

Furthermore, the speaker diaphragm may be arranged such that at least one of the top surface member and the rear surface member is made of a resin film, solid rubber, foamed rubber, urethane, fabric or paper impregnated with a resin material or rubber, an adhesive material, or any combination thereof.

Furthermore, the speaker diaphragm may be arranged such that the intermediate member is made of an adhesive material, an elastomer, a gel-like material, or a liquid.

Since the diaphragm is light and flexible, use of this diaphragm makes it possible to realize an efficient speaker that is excellent in terms of low sound reproduction characteristics.

Furthermore, the speaker diaphragm may be arranged such that the suspension has a roll-shaped or bellows-shaped cross section.

According to this arrangement, the supporting force of the suspension in the amplitude direction of the diaphragm is more linear with respect to the amplitude of the diaphragm than that in a case where the diaphragm is planar. It is therefore possible to more effectively improve the linearity of the suspension produced by the plurality of holes.

Furthermore, the speaker diaphragm may be arranged such that the one or more first holes and the one or more second holes are provided in the form of slits in a direction normal to the outer peripheral part of the vibrator.

Since the holes are slit-like holes, the suspension can more easily stretch and contract in a circumferential direction. This improves the linearity of the vibrator supporting force of the suspension and reduces the supporting force.

Furthermore, the speaker diaphragm may be arranged such that the one or more first holes and the one or more second holes are provided at a predetermined angle with respect to the direction normal to the outer peripheral part of the vibrator.

By providing the slit-like holes at an angle, the length of the slit-like holes can be made long. This further improves the linearity and flexibility of the suspension.

Furthermore, the speaker diaphragm may be arranged such that the outer peripheral part of the vibrator has a circular shape, an elliptic shape, a polygonal shape, or a shape combining two or more straight lines and two or more curves.

Furthermore, the speaker diaphragm may be arranged such that the outer peripheral part of the vibrator has a shape constituted by at least two straight lines and at least two curves.

Furthermore, the speaker diaphragm may be arranged such that the one or more first holes and the one or more second holes are provided only in the curves.

The stretching and contracting force applied in the circumferential direction of the suspension during vibration of the vibrator is due to a difference in length between the outer peripheral part of the suspension and the inner peripheral part of the suspension. Accordingly, a larger stretching and contracting force occurs in the curved parts where the difference between the outer peripheral part and the inner peripheral part is larger. Therefore, by providing a plurality of holes in the curved parts, it is possible to effectively achieve an improvement in the linearity of the vibrator supporting force and a reduction in the vibrator supporting force.

Furthermore, the speaker diaphragm may be arranged such that the first holes and the second holes are provided at uneven intervals.

By thus concentrating the holes in parts where a stress in the circumferential direction of the suspension is large, it is possible to effectively improve the linearity of the vibrator supporting force and reduce the supporting force.

Furthermore, the speaker diaphragm may be arranged such that the intermediate member has, at positions where the one or more first holes and the one or more second holes are disposed, an opening whose area is smaller than at least one of (i) the one or more first holes and (ii) the one or more second holes.

In this case, the opening of the intermediate member has a smaller opening area than the first holes and the second holes, the braking resistance of air passing through the opening is larger than air passing through first holes of a conventional example. Accordingly, antiphase sound occurring on the back side of the diaphragm during driving of the speaker is less likely to go around to the front side of the diaphragm. It is therefore possible to reduce undesirable cancellation of reproduced sound by antiphase sound occurring on the back side of the diaphragm. According to this arrangement, it is possible to achieve both (i) an improvement in linearity of the diaphragm supporting force and a reduction in the diaphragm supporting force due to opening and closing of the plurality of holes and (ii) a reduction of canceling of reproduced sound by antiphase sound occurring from the back side of the diaphragm, which is a conventional problem.

A speaker diaphragm including a vibrator and a suspension, a speaker, and a device may be realized by molding a top surface member, an intermediate member, and a rear surface member each having a planar shape into a specific shape that supports the vibrator so that the vibrator is capable of vibrating; forming the one or more first holes in the top surface member that has been molded into the specific shape; forming the one or more second holes in the rear surface member that has been molded into the specific shape; and stacking the top surface member in which the one or more first holes are formed, the intermediate member, and the rear surface member in which the one or more second holes are formed in this order so as to form the suspension of the speaker diaphragm.

By forming the holes after molding, it is possible to obtain the accuracy of the position and shape of the holes.

A speaker diaphragm including a vibrator and a suspension, a speaker, and a device may be realized by forming one or more first holes in a top surface member having a planar shape; forming one or more second holes in a rear surface member having a planar shape; stacking the top surface member in which the one or more first holes are formed, an intermediate member having a planar shape, and the rear surface member in which the one or more second holes are formed in this order, and molding the top surface member, the intermediate member, and the rear surface member that have been stacked on one another into a specific shape that supports the vibrator so that the vibrator is capable of vibrating so as to form the suspension of the speaker diaphragm.

In a case where the holes are formed in the members each having a planar shape, a simpler processing machine can be used, a higher productivity can be obtained, and a lower cost is needed than in a case where the holes are formed in a member having a three-dimensional shape. Furthermore, it is possible to easily achieve positioning and fixation of materials.

A speaker diaphragm including a vibrator and a suspension, a speaker, and a device may be realized by molding a top surface member, a intermediate member, and a rear surface member each having a planar shape into a specific shape that supports the vibrator so that the vibrator is capable of vibrating; stacking the top surface member, the intermediate member, and the rear surface member that have been molded into the specific shape in this order; and forming the one or more first holes in the top surface member and forming the one or more second holes in the rear surface member by using a half-cut method so as to form the suspension of the speaker diaphragm.

Use of a half-cut method allows processing after stacking. This makes it possible to prevent misalignment of the top surface member and the rear surface member, thereby achieving a suspension that has higher shape accuracy than in a case where holes are formed before stacking.

Furthermore, the speaker diaphragm may be arranged such that the one or more first holes and the one or more second holes are formed by using laser light or a machine blade.

A second aspect of the present disclosure is a speaker diaphragm including: a vibrator; a suspension that is adhered to an outer peripheral part of the vibrator, supports the vibrator so that the vibrator is capable of vibrating, and has one or more holes; and a sealing member that covers the one or more holes and has a rigidity lower than that of the suspension, wherein the sealing member is adhered to both a top surface of the suspension and side surfaces of the one or more holes.

A speaker may be realized by using the speaker diaphragm of the second aspect, and a device may be realized by using this speaker.

According to this arrangement, the holes open and close when the vibrator vibrates. This allows the suspension to smoothly stretch and contract in a circumferential direction. The sealing member is designed to have a rigidity lower than that of the suspension to an extent such that opening and closing of the holes are not inhibited. As a result, the linearity of the suspension improves. Furthermore, since the suspension smoothly moves due to opening and closing of the holes, it is possible to reduce the supporting force of the suspension in the amplitude direction of the vibrator. It is therefore possible to realize a speaker diaphragm that is capable of reproducing low pitch sound without changing the size of the speaker diaphragm.

Since antiphase sound occurring on the back side of the diaphragm during driving of the speaker does not go around to the front side of the diaphragm, it is possible to prevent the conventional problem in that reproduced sound is canceled out by antiphase sound occurring on the back side of the diaphragm. Furthermore, since the sealing member is adhered not only to the top surface of the suspension but also to side surfaces of the holes. Accordingly, the sealing member is less likely to be detached when the sealing member stretches and contracts during vibration of the vibrator than in a case where the sealing member is adhered only to the top surface of the suspension. According to this arrangement, it is possible to achieve both (i) an improvement in the linearity of the diaphragm supporting force and a reduction in the diaphragm supporting force due to opening and closing of the plurality of holes and (ii) prevention of the conventional problem in that reproduced sound is canceled out by antiphase sound occurring on the back side of the diaphragm and the sealing member is detached.

Furthermore, the speaker diaphragm may be arranged such that the sealing member is also adhered to a rear surface of the suspension.

According to this arrangement, it is possible to prevent the sealing member from being detached even in a case where the sealing member stretches and contracts due to opening and closing of the opening during vibration of the vibrator.

Furthermore, the speaker diaphragm may be arranged such that the suspension is made of a resin film, solid rubber, foamed rubber, urethane, fabric or paper impregnated with a resin material or rubber, an adhesive material, or any combination thereof.

Furthermore, the speaker diaphragm may be arranged such that the sealing member is made of an adhesive material, an elastomer, a gel-like material, or any combination thereof.

Since the diaphragm is light and flexible, use of this diaphragm makes it possible to realize an efficient speaker that is excellent in terms of low pitch reproduction characteristics.

Furthermore, the speaker diaphragm may be arranged such that the suspension has a roll-shaped or bellows-shaped cross section.

According to this arrangement, the supporting force of the suspension in the amplitude direction of the diaphragm is more linear with respect to the amplitude of the diaphragm than that in a case where the diaphragm is planar. It is therefore possible to more effectively improve the linearity of the suspension produced by the plurality of holes.

Furthermore, the speaker diaphragm may be arranged such that the one or more holes are provided in the form of slits in a direction normal to the outer peripheral part of the vibrator.

Since the holes are slit-like holes, the suspension can more easily stretch and contract in a circumferential direction. This improves the linearity of the vibrator supporting force of the suspension and reduces the supporting force.

Furthermore, the speaker diaphragm may be arranged such that the one or more holes are provided at a predetermined angle with respect to a direction normal to the outer peripheral part of the vibrator.

By providing the slit-like holes at an angle, the length of the slit-like holes can be made long. This further improves the linearity and flexibility of the suspension.

Furthermore, the speaker diaphragm may be arranged such that the outer peripheral part of the vibrator has a circular shape, an elliptic shape, a polygonal shape, or a shape combining two or more straight lines and two or more curves.

Furthermore, the speaker diaphragm may be arranged such that the outer peripheral part of the vibrator has a shape constituted by at least two straight lines and at least two curves.

Furthermore, the speaker diaphragm may be arranged such that the one or more holes are provided only in the curves.

In a case where the vibrator has any one of the aforementioned shapes, the vibrator supporting force of the suspension has a large influence in the curved parts. By providing a plurality of holes in the curved parts, it is possible to effectively achieve an improvement in the linearity of the vibrator supporting force and a reduction in the vibrator supporting force.

Furthermore, the speaker diaphragm may be arranged such that the holes are provided at uneven intervals.

By thus concentrating the holes in parts where a stress in the circumferential direction of the suspension is large, it is possible to effectively improve the linearity of the vibrator supporting force and reduce the supporting force.

A speaker diaphragm including a vibrator and a suspension, a speaker, and a device may be realized by molding a member having a planar shape into a specific shape that supports the vibrator so that the vibrator is capable of vibrating; forming one or more hole in the member that has been molded into the specific shape; and covering the one or more holes formed in the member with a sealing member so as to form the suspension of the speaker diaphragm.

A speaker diaphragm including a vibrator and a suspension, a speaker, and a device may be realized by forming one or more holes in member having a planar shape; covering the one or more holes formed in the member with a sealing member: and molding the member whose holes are covered with the sealing member into a specific shape that supports the vibrator so that the vibrator is capable of vibrating so as to form the suspension of the speaker diaphragm.

First Embodiment

Figure 1B:
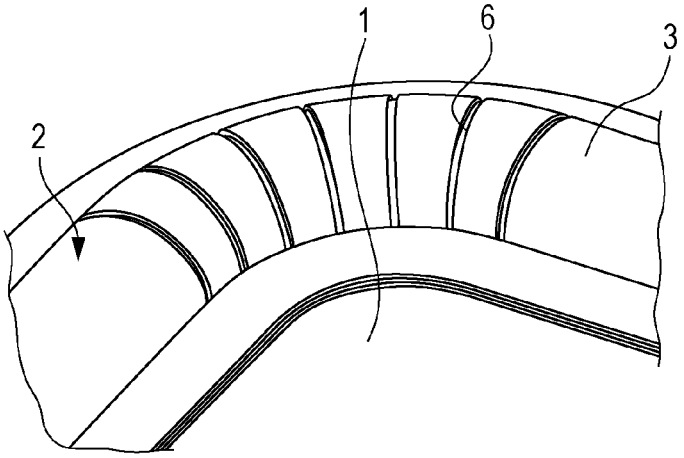
FIG. 1B is a perspective view of a structure of the part IB indicated by the dotted line in FIG. 1A.
Figure 1C:
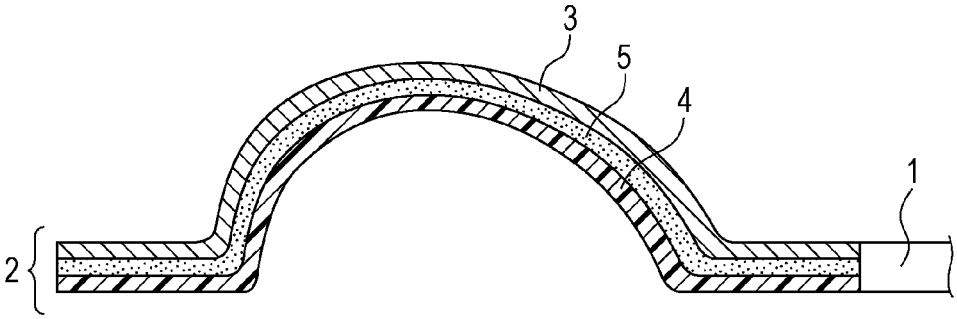
FIG. 1C is a cross-sectional view taken along the line IC-IC in FIG. 1A.
Figure 1D:
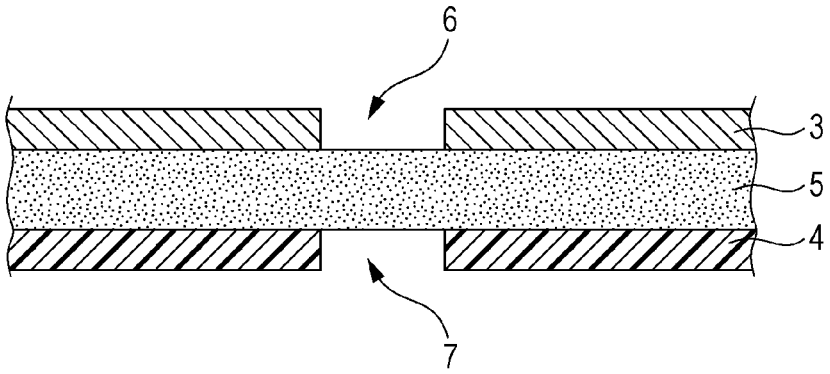
FIG. 1D is a cross-sectional view taken along the line ID-ID in FIG. 1A.

FIG. 1A is a top view of a speaker diaphragm according to the First Embodiment of the present disclosure. FIG. 1B is a perspective view for explaining a structure of the part IB indicated by the dotted line in FIG. 1A. FIG. 1C is a cross-sectional view taken along the line IC-IC in FIG. 1A. FIG. 1D is a cross-sectional view taken along the line ID-ID in FIG. 1A.

Configuration of Speaker Diaphragm

First, an example of a configuration of a speaker diaphragm according to the First Embodiment of the present disclosure is described. The speaker diaphragm according to the First Embodiment illustrated in FIGS. 1A through 1D includes a vibrator 1 (also referred to as a diaphragm 1) and a suspension 2.

The vibrator 1 has an outer peripheral part 1*a* that has, for example, a circular shape, an elliptic shape, a polygonal shape, or a shape combining two or more straight lines and two or more curves. For example, the outer peripheral part 1*a* has a so-called running track shape constituted by two straight lines and two semicircular curves, a rectangular shape whose four corners are rounded, or the like. The vibrator 1 illustrated in FIG. 1A has a substantially rectangular shape constituted by four straight lines and four curves.

The suspension 2 is an annular member that is constituted by an outer peripheral part 2*a* and an inner peripheral part 2*b* and that has a predetermined width. The suspension 2 is made of a material such as a resin film, solid rubber, foamed rubber, urethane, fabric or paper impregnated with a resin material or rubber, an adhesive material, or any combination thereof. The inner peripheral part 2*b* of the suspension 2 is adhered to the outer peripheral part 1*a* of the vibrator 1. Thus, the suspension 2 supports the vibrator 1 so that the vibrator 1 is capable of vibrating. That is, the inner peripheral part 2*b* of the suspension 2 has a shape identical to that of the outer peripheral part 1*a* of the vibrator 1.

As illustrated in FIG. 1C, the suspension 2 includes a top surface member 3, an intermediate member 5, and a rear surface member 4 that are stacked in this order. The intermediate member 5 has a rigidity lower than that of at least one of the top surface member 3 and the rear surface member 4 and is made of a material such as an adhesive material, an elastomer, a gel-like material, or a liquid.

As illustrated in FIGS. 1B and 1C, the suspension 2 is molded so as to have a cross section having a roll shape. The "roll shape" refers to a circular arc, an elliptic arc, or a similar shape. Note that the suspension 2 may be molded so as to have a cross section having a bellows shape made up of concavities and convexities (not illustrated). Furthermore, as illustrated in FIG. 1D, the suspension 2 is provided with slit-like first holes 6 passing through the top surface member 3 and slit-like second holes 7 passing through the rear surface member 4. As illustrated in FIG. 1A, the first holes 6 and the second holes 7 are formed at four corners of the suspension 2, which are curved parts of the suspension 2, in a direction from the inner peripheral part 2*b* toward the outer peripheral part 2*a* of the suspension 2. As illustrated in FIG. 1D, at least some of the first holes 6 and the second holes 7 are disposed so as to overlap each other across the intermediate member 5 in a direction in which the members are stacked. FIG. 1A illustrates an example in which 28 first holes 6 and 28 second holes 7 are provided.

A speaker (for example, FIG. 8A) in which the speaker diaphragm according to the First Embodiment is mounted reproduces sound by causing the vibrator 1 to vibrate back and forth (vibrates toward the near side and the depth side of the paper on which FIG. 1A is drawn). The suspension 2 supports the outer peripheral part 1*a* so that the vibrator 1 is capable of vibrating, and the outer peripheral part 2*a* of the suspension 2 is fixed to a chassis of the speaker. In the case where the roll shape of the suspension 2 bulges upward as illustrated in FIG. 1B, displacement of the vibrator 1 in a direction opposite to the bulging direction of the suspension 2 generates a stress in the compression direction on the inner peripheral side 2*b* of the suspension 2 and generates a stress in the stretching direction on the outer peripheral side 2*a* of the suspension 2 in the curved part (the part IB indicated by the dotted line in FIG. 1A) of the suspension 2. On the contrary, displacement of the vibrator 1 in a direction the same as the bulging direction of the suspension 2 generates a stress in the stretching direction on the inner peripheral side 2*b* of the suspension 2 and generates a stress in the compression direction on the outer peripheral side 2*a* of the suspension 2. In this case, the stresses are mitigated due to deformation of the slit-like first holes 6 and the slit-like second holes 7 provided in the suspension 2. This makes it easy for the suspension 2 to stretch and compress, thereby allowing the vibrator 1 to easily vibrate. Accordingly, the linearity of the supporting force of the suspension 2 with respect to the amplitude of the vibrator 1 improves. This makes it possible to reduce the harmonic distortion of sound reproduced by the speaker, thereby improving sound quality. At the same time, the supporting force of the suspension 2 is reduced. It is therefore possible to realize a speaker device that has better low pitch sound reproduction characteristics. Furthermore, the suspension 2 can prevent antiphase sound occurring on the back side of the vibrator 1 from going around to the front side of the vibrator 1 due to the presence of the intermediate member 5.

Figure 13:
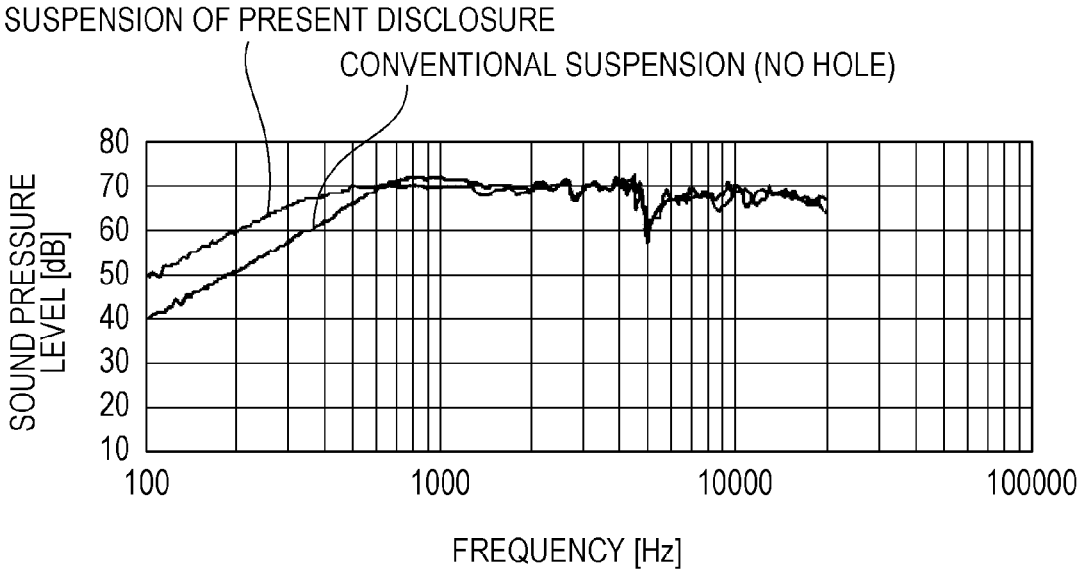
FIG. 13 is a diagram illustrating an example of characteristics of a speaker using the speaker diaphragm according to the present embodiment.
Figure 14:
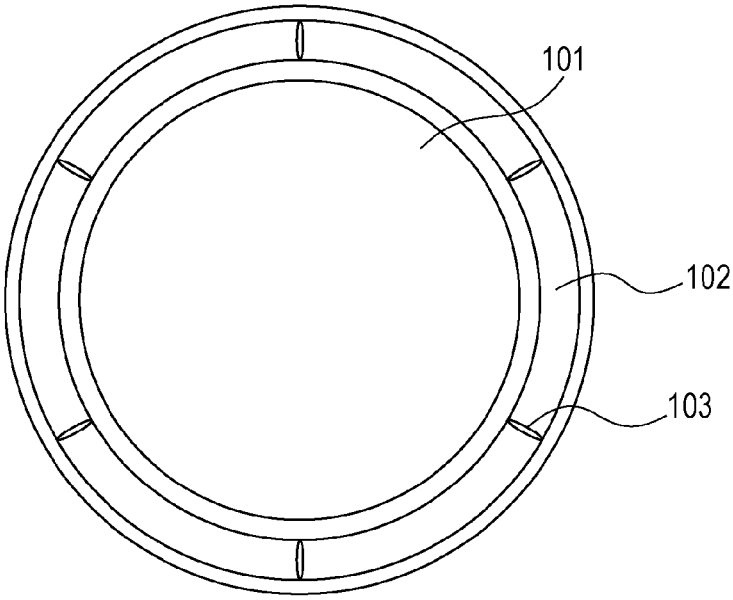
FIG. 14 is a diagram for explaining a conventional speaker diaphragm.
Figure 15A:
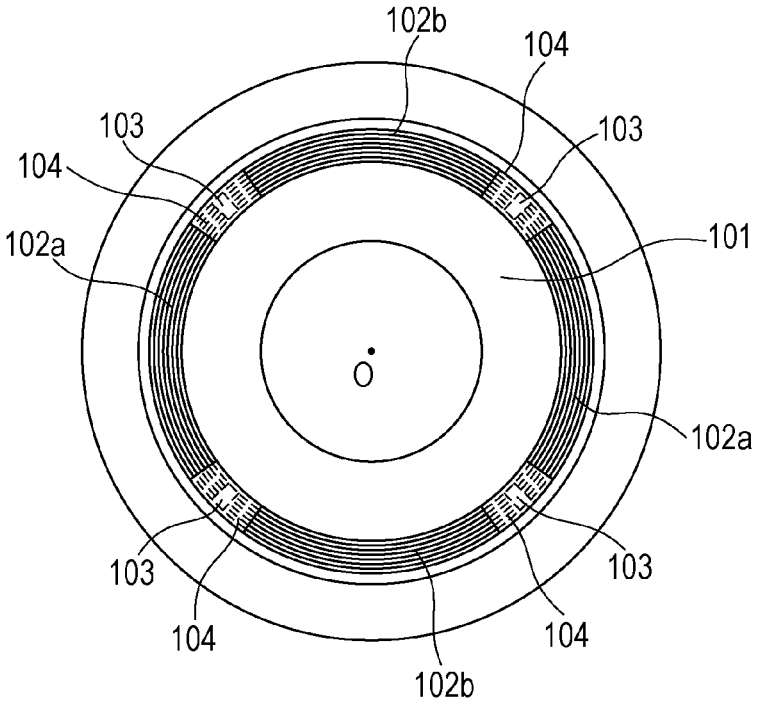
FIG. 15A is a diagram for explaining a conventional speaker diaphragm.
Figure 15B:
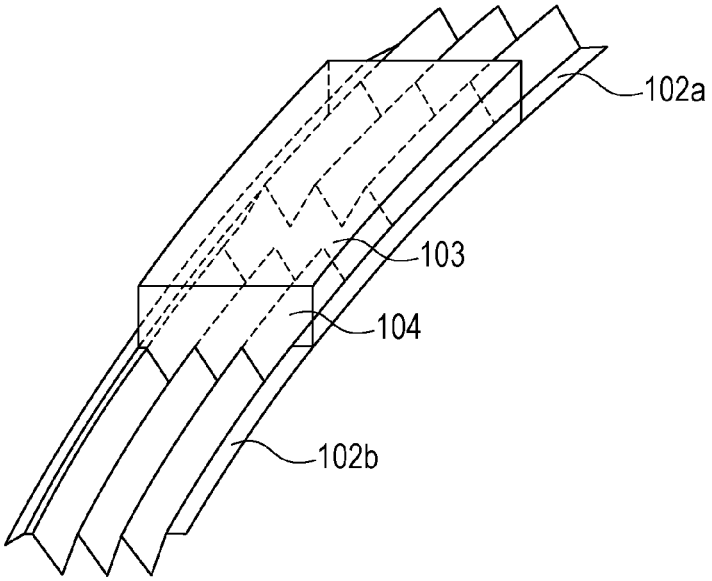
FIG. 15B is a diagram for explaining a conventional speaker diaphragm.

FIG. 13 illustrates an example of frequency-sound pressure level characteristics of a prototype speaker produced by using the speaker diaphragm of the present disclosure. PEEK (polyether ether ketone) having a thickness of 6 μm is used as the top surface member 3 and the rear surface member 4. An adhesive layer having a thickness of 30 μm is used as the intermediate member 5. The slit width of each of the first holes 6 and the second holes 7 is approximately 0.15 mm. As is clear from FIG. 13, according to the present prototype, characteristics on the low-frequency side are markedly reduced as compared with characteristics of a speaker using a conventional diaphragm (PEEK of 25 μm that is not a multilayer, a suspension of the same shape) having no first hole 6 and no second hole 7.

The first holes 6 and the second holes 7 are opened and closed when the vibrator 1 vibrates. However, if the width of each of these slit-like holes is not sufficient, displacement at the maximum amplitude of the vibrator 1 in a direction in which the slits are narrowed causes the sides of some of the slit-like holes to make contact with each other and inhibits vibration. It is therefore desirable that the first holes 6 and the second holes 7 have a certain slit width or larger so that the sides of the slits do not make contact with each other at the maximum amplitude of the vibrator 1.

Method for Manufacturing Speaker Diaphragm

Next, an example of a method for manufacturing the suspension 2 of the speaker diaphragm according to the First Embodiment of the present disclosure is described.

Figure 2A:
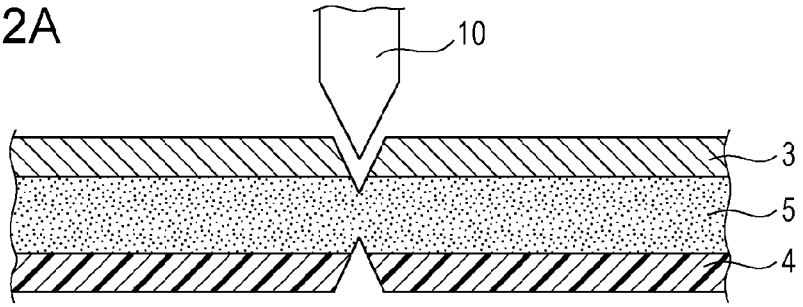
FIG. 2A is a diagram illustrating an example of a method for manufacturing the speaker diaphragm according to the present embodiment.

FIG. 2A is diagram for explaining one step of a manufacturing method using a half-cut method. According to this method, the top surface member 3, the intermediate member 5, and the rear surface member 4 each having a substantially planar shape are molded into a specific shape (cross section having a roll shape, a bellows shape, or the like) that supports the vibrator 1 so that the vibrator 1 is capable of vibrating. The top surface member 3, the intermediate member 5, and the rear surface member 4 that have been molded into this specific shape are stacked in this order so as to constitute a multilayer structure. Then, the top surface member 3 and the rear surface member 4 of this multilayer structure is processed by using a machine blade 10 by a half-cut method so as to form the first holes 6 and the second holes 7 (FIG. 2A).

It is desirable that the intermediate member 5 be not scraped away by this processing, but part of the intermediate member 5 may be scraped away as illustrated in FIG. 2A. The vertical cross sections of the first holes 6 and the second holes 7 illustrated in FIG. 1D are not obtained depending on the shape of the machine blade 10. However, this has no significant effect on the performance.

The first holes 6 and the second holes 7 may be formed by using laser light (not illustrated). In this case, use of a material that reflects or absorbs the laser light as the intermediate member 5 allows the laser light that has cut the top surface member 3 and the rear surface member 4 to be reflected or absorbed by the intermediate member 5, thereby preventing the intermediate member 5 from being cut.

Figure 2B:
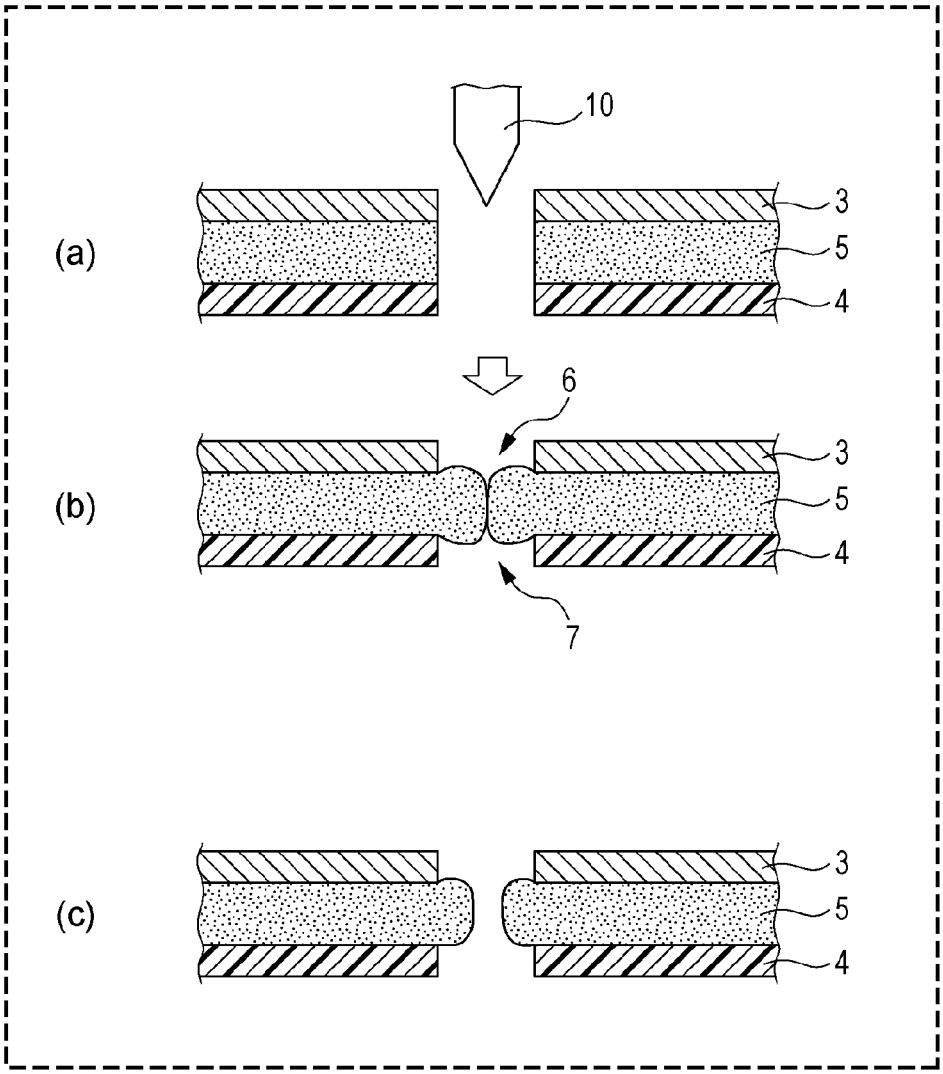
FIG. 2B is a diagram illustrating an example of a method for manufacturing the speaker diaphragm according to the present embodiment.

FIG. 2B is a diagram for explaining one step of a manufacturing method using an extrusion method. According to this method, a multilayer structure is formed in advance by stacking the top surface member 3, the intermediate member 5, and the rear surface member 4 each having a planar shape in this order. A material that is softened by heat is used as the intermediate member 5. By applying the machine blade 10 or laser light (not illustrated) to this multilayer structure, the first holes 6 and the second holes 7 passing through the intermediate member 5 are formed ((a) of FIG. 2B). Then, the multilayer structure having the through-holes is put into a roll-shaped mold and is heated and pressurized. The molding heat softens the intermediate member 5 and the molding pressure extrudes the intermediate member 5 into the through-holes ((b) of FIG. 2B). As a result, the extruded parts of the intermediate member 5 are connected inside the through-holes. This achieves a configuration similar to that of FIG. 1D.

According to this manufacturing method, in a case where the molding heat or the molding pressure is insufficient, there are cases where the extruded parts of the intermediate member 5 are not connected inside the through-holes and openings are formed, as illustrated in (c) of FIG. 2B. In a case where the openings are formed, the intermediate member 5 cannot completely prevent antiphase sound occurring on the back side of the vibrator 1 from going around to the front side of the vibrator 1. However, according to the present embodiment, gaps (the width of the openings) through which antiphase sound passes are narrower due to the extruded parts of the intermediate member 5 than those in the conventional art in which the width of the openings are identical to that of the first holes 6. That is, the speaker diaphragm according to the configuration of the present embodiment has an effect that the proportion of reproduced sound canceled out by antiphase sound going around to the front side of the vibrator 1 can be made smaller than that in a speaker diaphragm having the conventional configuration.

Figure 2C:
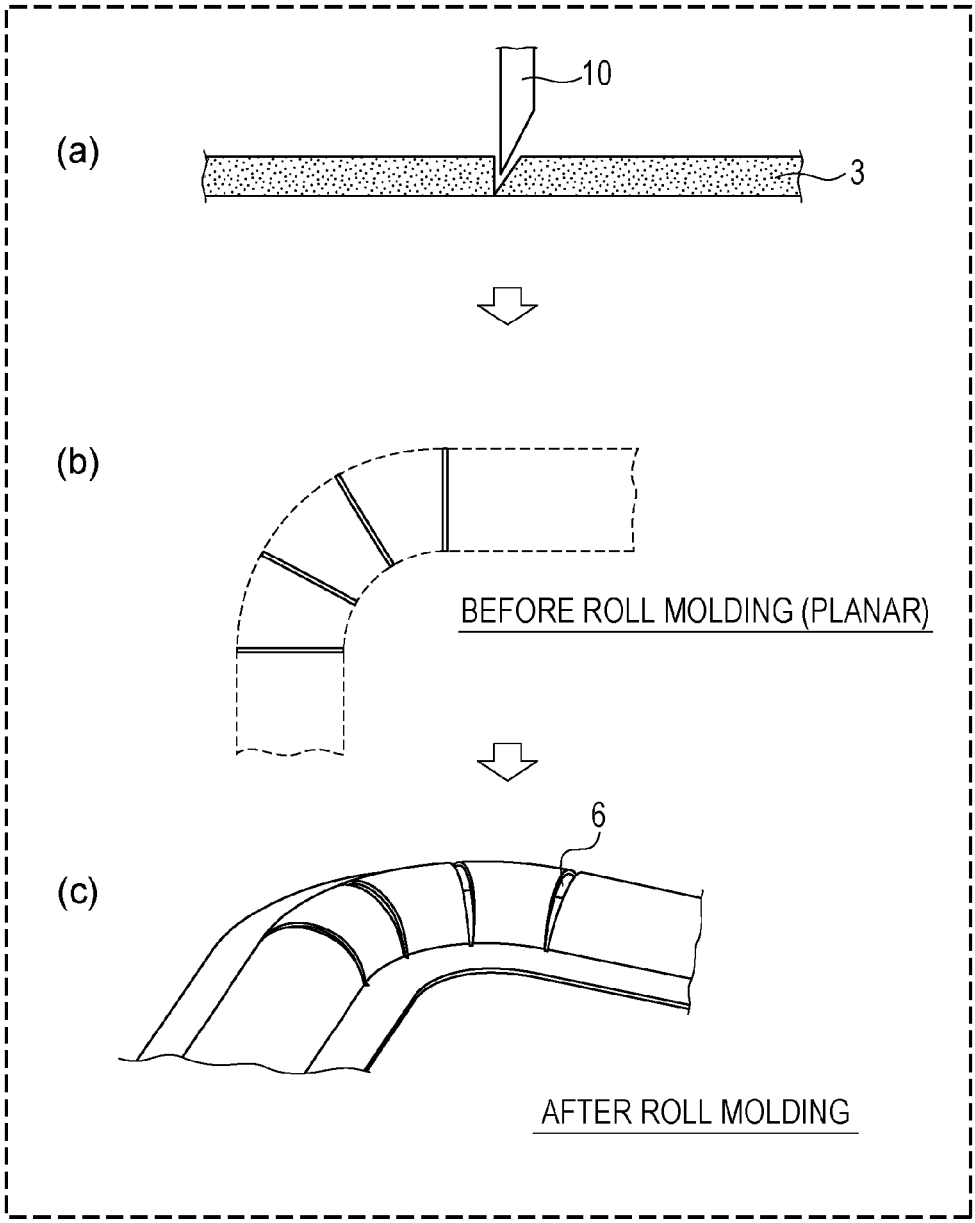
FIG. 2C is a diagram illustrating an example of a method for manufacturing the speaker diaphragm according to the present embodiment.

FIG. 2C is a diagram for explaining one step of a manufacturing method for a speaker having a small diameter. In a case where a speaker has a small diameter, the size of the suspension 2 is also small, and therefore it is sometimes necessary to set the width of the slits to be smaller. Forming small slit holes with high precision is not technically easy. In view of this, holes are formed in the top surface member 3 and the rear surface member 4 by using a single blade as illustrated in (a) of FIG. 2C before the top surface member 3 and the rear surface member 4 are molded into a three-dimensional shape, i.e., in a state where the top surface member 3 and the rear surface member 4 have a planar shape ((b) of FIG. 2C). Then, the suspension 2 is molded into a roll shape. The stress during the molding opens the first holes 6 and the second holes 7 as illustrated in (c) of FIG. 2C. According to this manufacturing method, it is possible to form holes whose width is large enough to prevent contact between sides of the holes even if the vibrator 1 is displaced in a direction in which the holes are narrowed.

Effects Produced by Present Embodiment

According to the speaker diaphragm according to the First Embodiment of the present disclosure, when the vibrator 1 vibrates, the first holes 6 and the second holes 7 provided in the top surface member 3 and the rear surface member 4 open and close. This allows the top surface member 3 and the rear surface member 4 that constitute the suspension 2 to smoothly stretch and contract in the circumferential direction. The rigidity of the intermediate member 5 is set lower than that of the top surface member 3 and the rear surface member 4 to an extent such that opening and closing of the holes are not inhibited. As a result, the linearity of the suspension 2 improves. Furthermore, since the suspension 2 smoothly moves due to opening and closing of the holes, it is possible to reduce the supporting force of the suspension 2 in the amplitude direction of the vibrator 1. It is therefore possible to realize a speaker diaphragm that is capable of reproducing low pitch sound without changing the size of the speaker diaphragm. Furthermore, the presence of the intermediate member 5 between the top surface member 3 and the rear surface member 4 prevents antiphase sound occurring on the back side of the vibrator 1 during driving of the speaker from going around to the front side of the vibrator 1. That is, it is possible to prevent the conventional problem in that reproduced sound is canceled out by antiphase sound from the back side of the diaphragm. The possibility of detachment of the intermediate member 5 is extremely low since the intermediate member 5 is sandwiched between the top surface member 3 and the rear surface member 4.

APPLICATION EXAMPLE

Some application examples using the speaker diaphragm according to the First Embodiment described above are described with reference to FIGS. 3A through 3E.

Figure 3A:
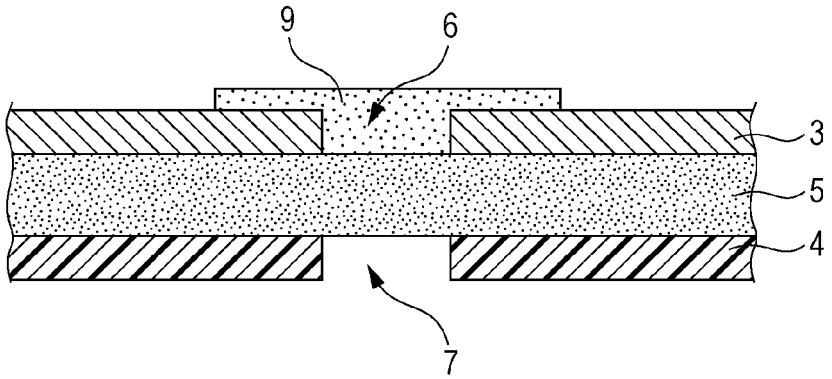
FIG. 3A is a diagram illustrating an application example using the speaker diaphragm according to the present embodiment.
Figure 3B:
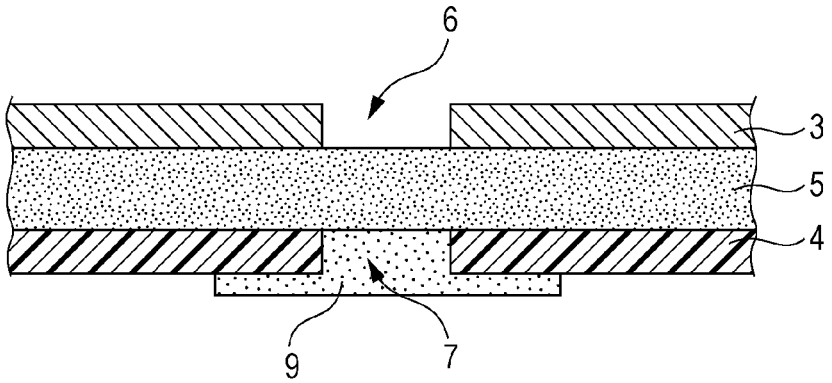
FIG. 3B is a diagram illustrating an application example using the speaker diaphragm according to the present embodiment.

FIG. 3A illustrates a structure in which a sealing member 9 is provided so as to cover the first holes 6 of the top surface member 3. In a case where a speaker is mounted on a cabinet, a force according to acoustic compliance of the cabinet sometimes works on the suspension 2 during driving of the speaker. Furthermore, the intermediate member 5 is subject to repeated stresses in accordance with opening and closing of the first holes 6 and the second holes 7 caused by vibration of the vibrator 1. The configuration of this application example is for reinforcing the intermediate member 5 by using the sealing member 9 so that the intermediate member 5 has sufficient strength against the stresses.

According to this structure, the sealing member 9 is provided so as to fill the first holes 6. That is, the sealing member 9 is adhered to not only the top surface of the top surface member 3 but also the inner side surfaces of the first holes 6. This achieves a larger adhesion area between the sealing member 9 and the suspension 2 than that in the configuration of Japanese Unexamined Patent Application Publication No. 6-105393 described in the BACKGROUND, thereby suppressing detachment of the sealing member 9.

Figure 3C:
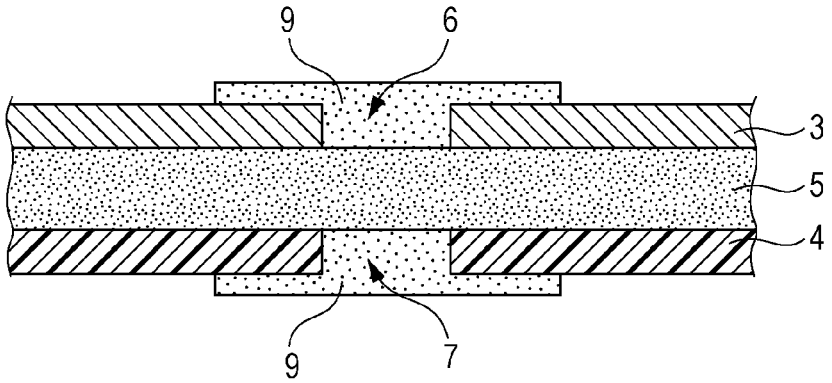
FIG. 3C is a diagram illustrating an application example using the speaker diaphragm according to the present embodiment.

The sealing member 9 may be provided so as to cover the second holes 7 of the rear surface member 4 (FIG. 3B) or may be provided so as to cover both the first holes 6 of the top surface member 3 and the second holes 7 of the rear surface member 4 (FIG. 3C). Furthermore, the position of the sealing member 9 is not limited to parts of the top surface member 3 that cover the first holes 6 and parts of the rear surface member 4 that cover the second holes 7, and the sealing member 9 may be provided on the whole area of the top surface member 3 and the rear surface member 4 (not illustrated).

It is desirable that the sealing member 9 be made of a softer material, such as an elastomer, an adhesive material, a gel-like material, or a liquid that is hard to vaporize (silicon oil), so as not to inhibit opening and closing of the first holes 6 of the top surface member 3 and the second holes 7 of the rear surface member 4.

Figure 3D:
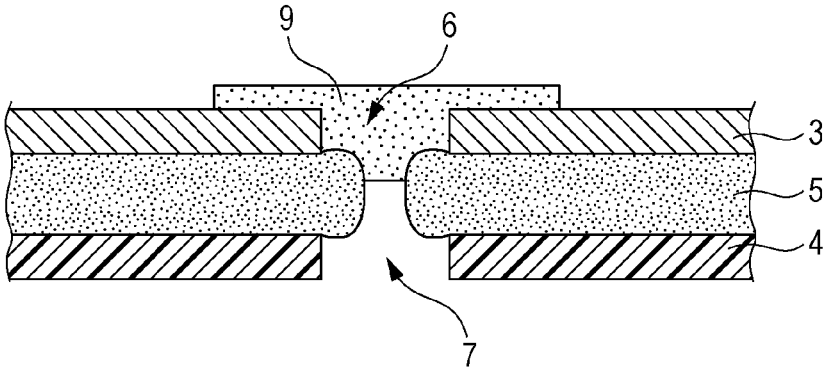
FIG. 3D is a diagram illustrating an application example using the speaker diaphragm according to the present embodiment.
Figure 3E:
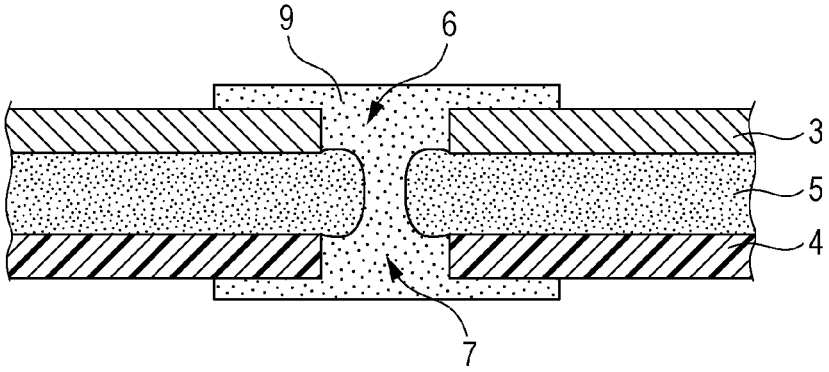
FIG. 3E is a diagram illustrating an application example using the speaker diaphragm according to the present embodiment.

This sealing member 9 is especially useful for the configuration illustrated in (c) of FIG. 2B that is referred to in the description of the above manufacturing method. That is, presence of the sealing member 9 makes it possible to surely prevent antiphase sound from going around to the front side of the vibrator 1 (FIG. 3D). Furthermore, in a case where the sealing member 9 is also adhered to the rear surface member 4 side (FIG. 3E), it is possible to more effectively prevent detachment or dropping of the sealing member 9.

Second Embodiment

Figure 4A:
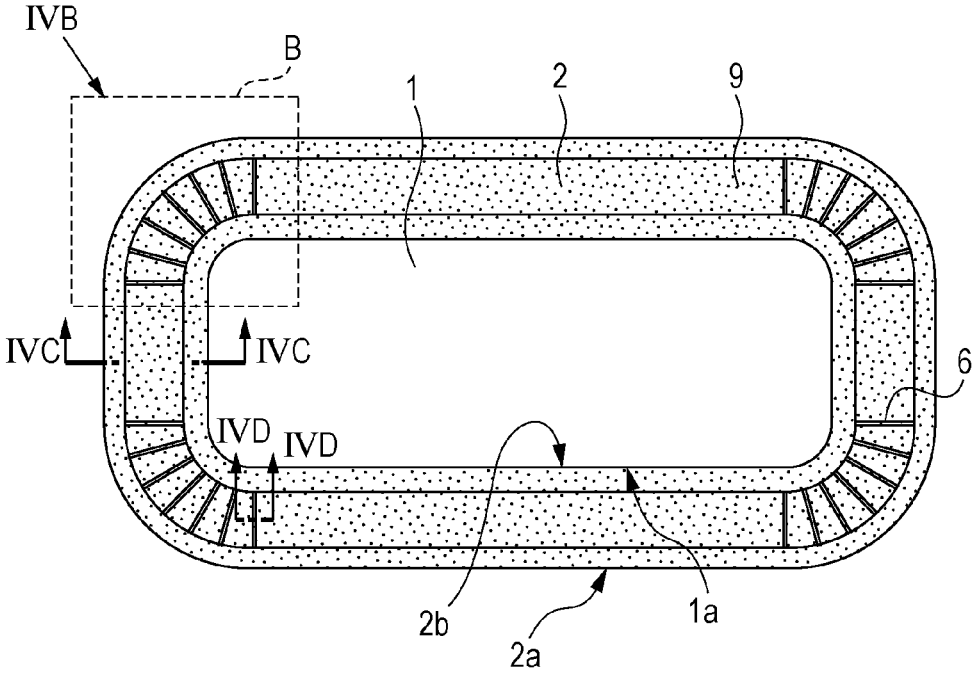
FIG. 4A is a top view of a speaker diaphragm according to the present embodiment.
Figure 4B:
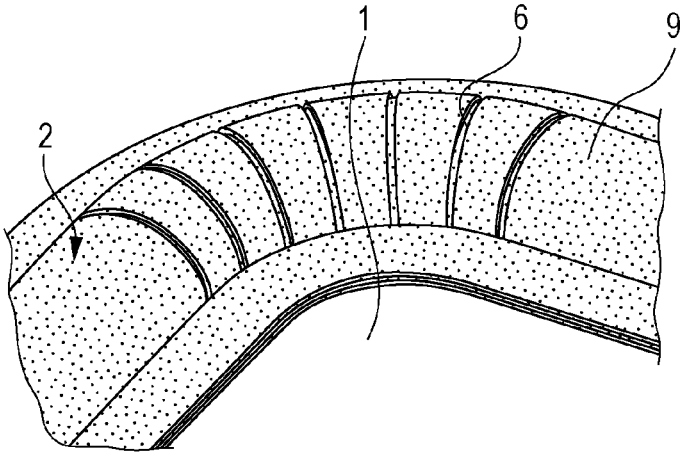
FIG. 4B is a perspective view of a structure of the part IVB indicated by the dotted line in FIG. 4A.
Figure 4C:
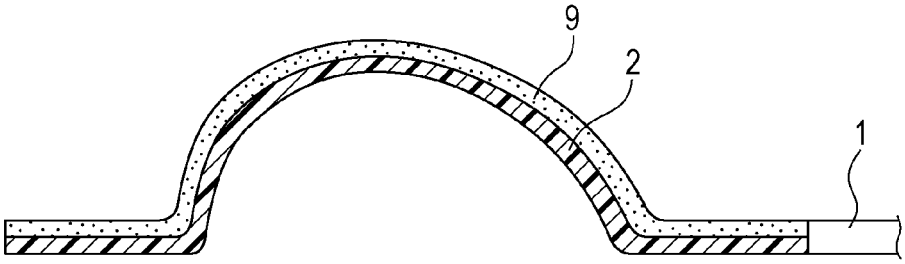
FIG. 4C is a cross-sectional view illustrating an example of a cross section taken along the line IVC-IVC in FIG. 4A.
Figure 4D:
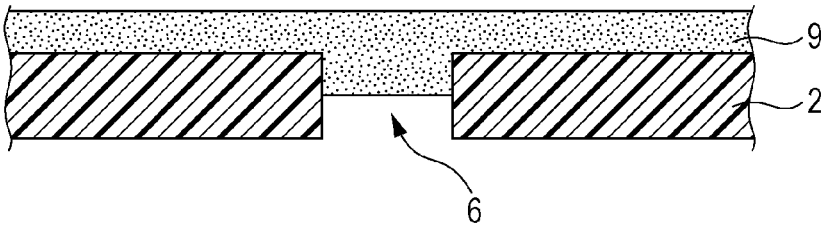
FIG. 4D is a cross-sectional view illustrating an example of a cross section taken along the line IVD-IVD in FIG. 4A.

FIG. 4A is a top view of a speaker diaphragm according to the Second Embodiment of the present disclosure. FIG. 4B is a perspective view for explaining a structure of the part IVB indicated by the dotted line in FIG. 4A. FIG. 4C is a cross-sectional view taken along the line IVC-IVC in FIG. 4A. FIG. 4D is a cross-sectional view taken along the line IVD-IVD in FIG. 4A.

Configuration of Speaker Diaphragm

First, the configuration of the speaker diaphragm according to the Second Embodiment of the present disclosure is described. The speaker diaphragm according to the Second Embodiment illustrated in FIGS. 4A through 4D includes a vibrator 1, a suspension 2, and a sealing member 9.

The vibrator 1 has an outer peripheral part 1*a* that has, for example, a circular shape, an elliptic shape, a polygonal shape, or a shape combining two or more straight lines and two or more curves. The vibrator 1 illustrated in FIG. 4A has a substantially rectangular shape constituted by four straight lines and four curves.

The suspension 2 is an annular member that is constituted by an outer peripheral part 2*a* and an inner peripheral part 2*b* and that has a predetermined width. The suspension 2 is made of a material such as a resin film, solid rubber, foamed rubber, urethane, fabric or paper impregnated with a resin material or rubber, an adhesive material, or any combination thereof. The inner peripheral part 2*b* of the suspension 2 is adhered to the outer peripheral part 1*a* of the vibrator 1. Thus, the suspension 2 supports the vibrator 1 so that the vibrator 1 is capable of vibrating. That is, the inner peripheral part 2*b* of the suspension 2 has a shape identical to that of the outer peripheral part 1*a* of the vibrator 1.

As illustrated in FIGS. 4B and 4C, the suspension 2 is molded so as to have a cross section having a roll shape. The "roll shape" refers to a circular arc, an elliptic arc, or a similar shape. Note that the suspension 2 may be molded so as to have a cross section having a bellows shape made up of concavities and convexities (not illustrated). Furthermore, as illustrated in FIG. 4D, the suspension 2 is provided with slit-like holes 6 (openings). As illustrated in FIG. 4A, the holes 6 are formed at four corners of the suspension 2, which are curved parts of the suspension 2, in a direction from the inner peripheral part 2*b* toward the outer peripheral part 2*a* of the suspension 2. FIG. 4A illustrates an example in which 28 holes 6 are provided.

The sealing member 9 is provided on the whole surface of the suspension 2 so as to cover the holes 6 (expressed by shading in FIGS. 4A through 4H). The sealing member 9 is adhered to not only the top surface of the suspension 2 but also the inner side surfaces of the holes 6. This achieves a larger adhesion area between the sealing member 9 and the suspension 2 than that in the configuration of Japanese Unexamined Patent Application Publication No. 6-105393 described in the BACKGROUND, thereby suppressing detachment of the sealing member 9.

An example of a cross-section taken along the line IVD-IVD in FIG. 4A is illustrated in FIG. 4D, but the cross-section is not limited to this. FIGS. 4E through 4H are cross-sectional views illustrating other examples of the cross-section taken along the line IVD-IVD in FIG. 4A.

Figure 4E:
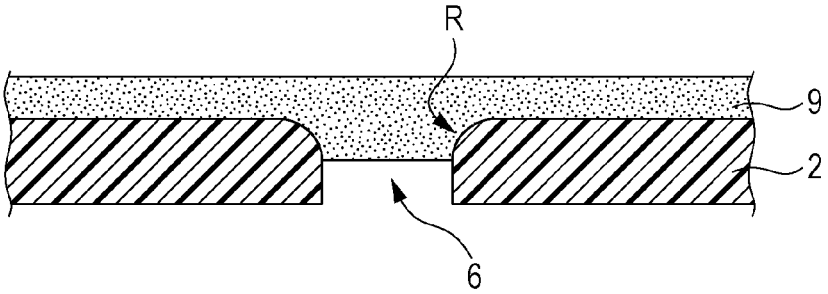
FIG. 4E is a cross-sectional view illustrating an example of another configuration of the cross section taken along the line IVD-IVD illustrated in FIG. 4D.
Figure 4F:
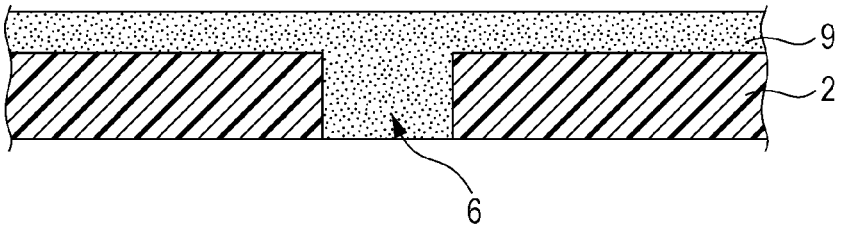
FIG. 4F is a cross-sectional view illustrating an example of another configuration of the cross section taken along the line IVD-IVD illustrated in FIG. 4D.
Figure 4G:
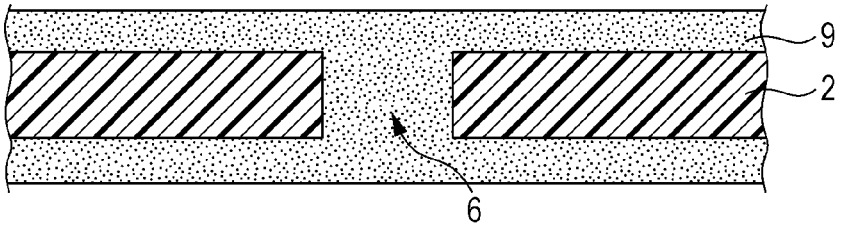
FIG. 4G is a cross-sectional view illustrating an example of another configuration of the cross section taken along the line IVD-IVD illustrated in FIG. 4D.
Figure 4H:
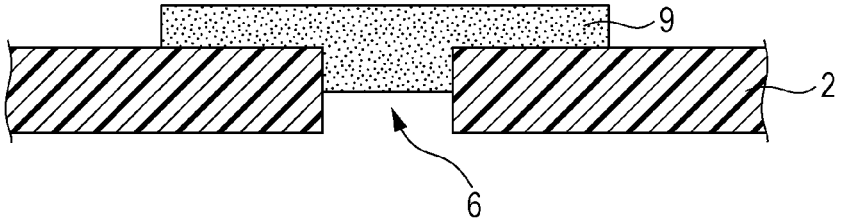
FIG. 4H is a cross-sectional view illustrating an example of another configuration of the cross section taken along the line IVD-IVD illustrated in FIG. 4D.

As a method for further increasing the adhesion area between the sealing member 9 and the suspension 2, the corners of the holes 6 of the suspension 2 may be rounded off (R) as illustrated in FIG. 4E. Presence of R prevents a stress from being concentrated at the corners when the sealing member 9 stretches and contracts. This makes it possible to prevent the sealing member 9 from being broken. The sealing member 9 may be provided so as to cover the whole inner side surfaces of the holes 6 of the suspension 2 as illustrated in FIG. 4F or may be provided so as to also cover the rear surface of the suspension 2 through the holes 6 as illustrated in FIG. 4G. This makes it possible to further increase the adhesion strength between the sealing member 9 and the suspension 2. According to this structure, a material having a larger internal loss such as an elastomer is applied to both surfaces of the suspension 2. This increases the loss coefficient of the suspension 2. The increase in the loss coefficient of the suspension 2 produces an effect of preventing abnormal noise occurring from the suspension 2 and improving the quality of sound reproduced by the speaker. Note that the sealing member 9 does not need to be provided on the whole surface of the suspension 2, and the sealing member 9 may be provided on only parts of the suspension 2 that cover the holes 6 (FIG. 4H).

It is desirable that the sealing member 9 be made of a material softer than the suspension 2 so as not to inhibit opening and closing of the holes 6 of the suspension 2. Moreover, the sealing member 9 is required to have durability so as to be able to withstand repeated stretching and compression caused by the holes 6 that repeatedly open and close every time the vibrator 1 vibrates. Furthermore, the adhesion strength between the sealing member 9 and the suspension 2 is also needed. It is therefore desirable that the sealing member 9 be made of a material taking these factors into consideration such as an elastomer, an adhesive material, a gel-like material, or a liquid that is hard to vaporize (silicon oil).

A speaker (for example, FIG. 8A) in which the speaker diaphragm according to the Second Embodiment is mounted reproduces sound by causing the vibrator 1 to vibrate back and forth (vibrates toward the near side and the depth side of the paper on which FIG. 4A is drawn). The suspension 2 supports the outer peripheral part 1*a* so that the vibrator 1 is capable of vibrating, and the outer peripheral part 2*a* of the suspension 2 is fixed to a chassis of the speaker. In a case where the roll shape of the suspension 2 bulges upward as illustrated in FIG. 4B, displacement of the vibrator 1 in a direction opposite to the bulging direction of the suspension 2 generates a stress in the compression direction on the inner peripheral side 2*b* of the suspension 2 and generates a stress in the stretching direction on the outer peripheral side 2*a* of the suspension 2 in the curved part (the part IVB indicated by the dotted line in FIG. 4A) of the suspension 2. On the contrary, displacement of the vibrator 1 in a direction the same as the bulging direction of the suspension 2 generates a stress in the stretching direction on the inner peripheral side 2*b* of the suspension 2 and generates a stress in the compression direction on the outer peripheral side 2*a* of the suspension 2. In this case, the stresses are mitigated due to deformation of the slit-like holes 6 provided in the suspension 2. In this case, the stresses are mitigated due to deformation of the slit-like holes 6 provided in the suspension 2. This makes it easy for the suspension 2 to stretch and compress, thereby allowing the vibrator 1 to easily vibrate. Accordingly, the linearity of the supporting force of the suspension 2 with respect to the amplitude of the vibrator 1 improves. This makes it possible to reduce harmonic distortion of sound reproduced by the speaker, thereby improving sound quality. At the same time, the supporting force of the suspension 2 is reduced. It is therefore possible to realize a speaker device that has better low pitch sound reproduction characteristics. Furthermore, the suspension 2 can prevent antiphase sound occurring on the back side of the vibrator 1 from going around to the front side of the vibrator 1 due to the presence of the sealing member 9.

The holes 6 open and close when the vibrator 1 vibrates. However, if the width of each of these slit-like holes is not sufficient, displacement at the maximum amplitude of the vibrator 1 in a direction in which the slits are narrowed causes the sides of some of the slit-like holes to make contact with each other and inhibit vibration. It is therefore desirable that the holes 6 have a certain slit width or larger so that the sides of the slits do not make contact with each other at the maximum amplitude of the vibrator 1.

Method for Manufacturing Speaker Diaphragm

Next, a method for manufacturing the suspension 2 of the speaker diaphragm according to the Second Embodiment is described.

Figure 5:
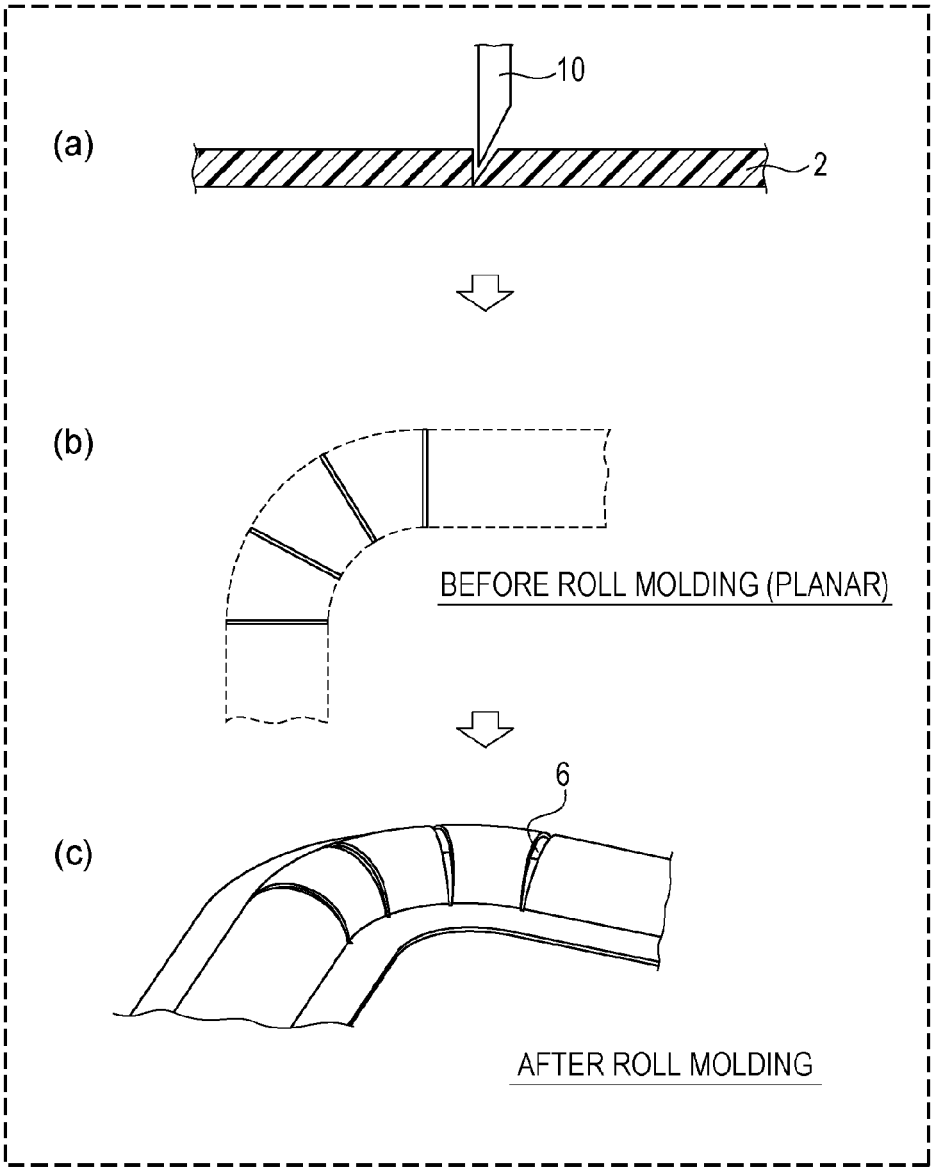
FIG. 5 is a diagram illustrating an example of a method for manufacturing the speaker diaphragm according to the present embodiment.

FIG. 5 is a diagram for explaining one step of a method for manufacturing the suspension 2. According to this method, first, linear slits are formed in the suspension 2 having a planar shape by using the machine blade 10 illustrated in (a) of FIG. 5 ((b) of FIG. 5). The linear slits may be formed by using laser processing. Then, the suspension 2 is molded into a roll shape. Since the material of the suspension 2 is stretched due to a stress applied during the molding, the holes 6 open as illustrated in (c) of FIG. 5. According to this manufacturing method, it is possible to form holes whose width is large enough to prevent the sides of the holes from making contact with each other even if the vibrator 1 is displaced in a direction in which the holes are narrowed.

Another manufacturing method is a method for forming the holes 6 after molding the suspension 2 into a roll shape. However, in a case where the speaker has a small diameter, the size of the suspension 2 is also small, therefore it is sometimes necessary to set the width of the slits narrow. In this case, it is technically difficult to place two blades in a narrow range. Moreover, the blades cannot have a sufficient height, and therefore the blades have a short life-span and low mass productivity.

Effects Produced by Present Embodiment

According to the speaker diaphragm according to the Second Embodiment of the present disclosure, when the vibrator 1 vibrates, the holes 6 open and close. This allows the suspension 2 to smoothly stretch and contract in the circumferential direction. The rigidity of the sealing member 9 is set lower than that of the suspension 2 to an extent such that opening and closing of the holes 6 are not inhibited. As a result, the linearity of the suspension 2 improves. Furthermore, since the suspension 2 smoothly moves due to opening and closing of the holes 6, it is possible to reduce the supporting force of the suspension 2 in the amplitude direction of the vibrator 1. It is therefore possible to realize a speaker diaphragm that is capable of reproducing low pitch sound without changing the size of the speaker diaphragm. Furthermore, presence of the sealing member 9 prevents antiphase sound occurring on the back side of the vibrator 1 during driving of the speaker from going around to the front side of the vibrator 1. That is, it is possible to prevent the conventional problem that reproduced sound is canceled out by antiphase sound from the back side of the diaphragm. Furthermore, since the sealing member 9 is adhered not only on the top surface of the suspension 2 but also on the side surfaces of the holes 6, the sealing member 9 is less likely to be detached than in a case where the sealing member 9 is adhered only on the top surface of the suspension 2.

Modifications

Figure 6A:
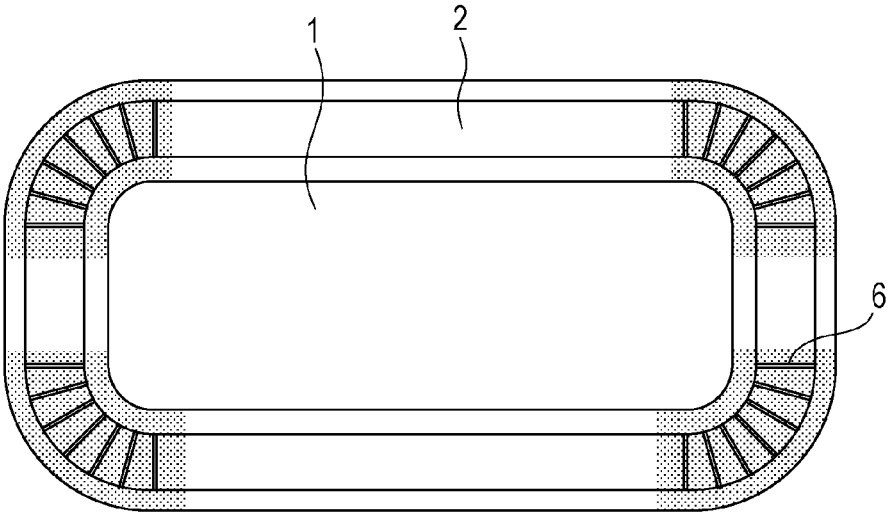
FIG. 6A is a diagram illustrating a modification of the speaker diaphragm according to the present embodiment.
Figure 6B:
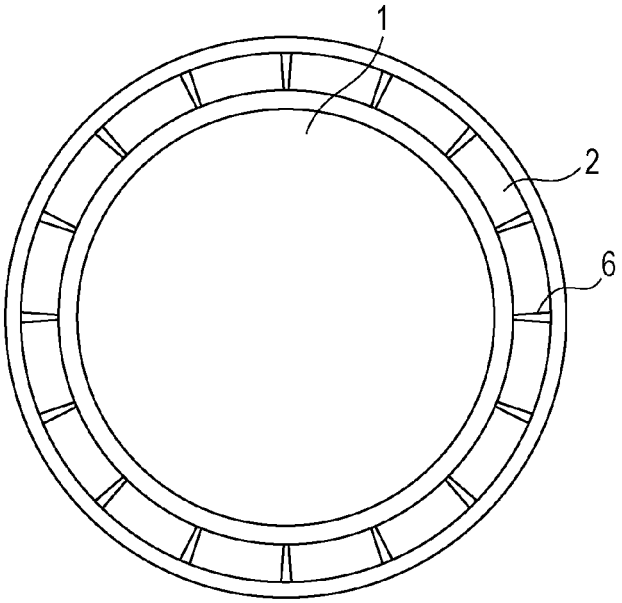
FIG. 6B is a diagram illustrating a modification of the speaker diaphragm according to the present embodiment.
Figure 6C:
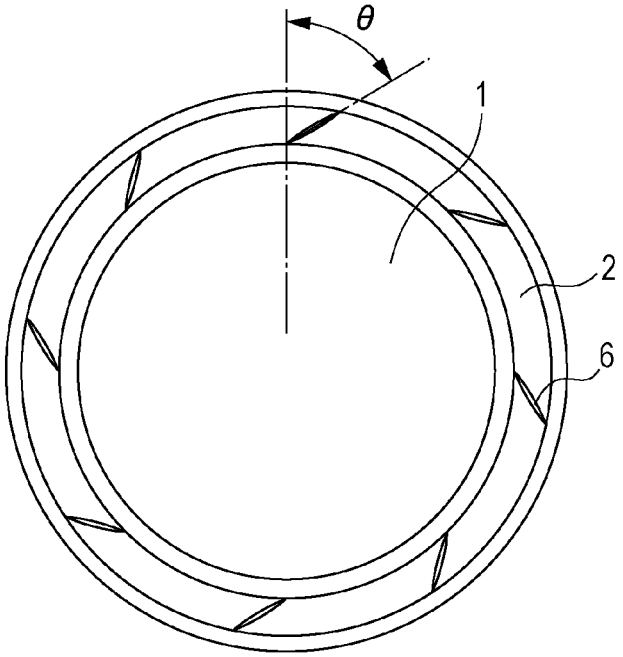
FIG. 6C is a diagram illustrating a modification of the speaker diaphragm according to the present embodiment.
Figure 6D:
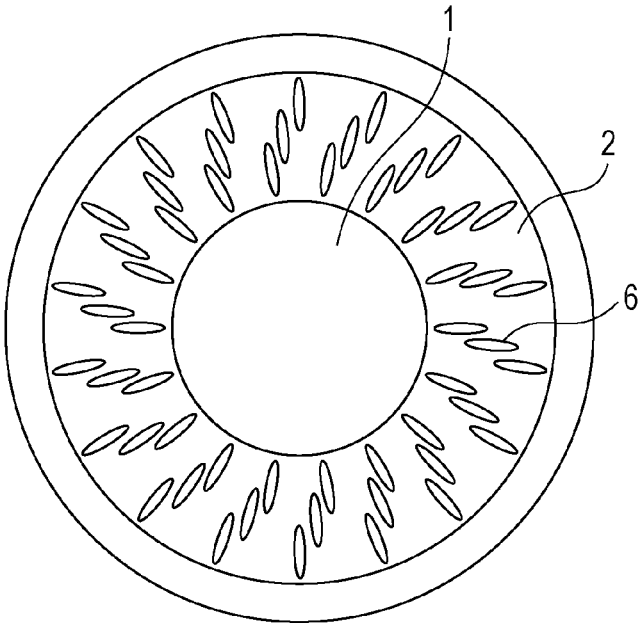
FIG. 6D is a diagram illustrating a modification of the speaker diaphragm according to the present embodiment.

Some modifications of the speaker diaphragms according to the First Embodiment and the Second Embodiment of the present disclosure are described. FIG. 6A is a top view of a speaker diaphragm according to Modification 1. FIG. 6B is a top view of a speaker diaphragm according to Modification 2. FIG. 6C is a top view of a speaker diaphragm according to Modification 3. FIG. 6D is a top view of a speaker diaphragm according to Modification 4. FIGS. 7A through 7F are diagrams illustrating various modifications of the first holes 6 and the second holes 7.

In Modification 1 illustrated in FIG. 6A, the suspension 2 has a different configuration. In the case of the structure of the First Embodiment, the multilayer structure including the top surface member 3, the intermediate member 5, and the rear surface member 4 is provided only at the four corners (the shaded parts in FIG. 6A), which are curved parts, where the first holes 6 and the second holes 7 of the suspension 2 are provided. That is, the top surface member 3 and the intermediate member 5 are disposed only at these four corners, and only the rear surface member 4 is disposed at the other parts. In the case of the structure of the Second Embodiment, the sealing member 9 is provided only at the four corners (the shaded parts in FIG. 6A), which are curved parts, where the holes 6 of the suspension 2 are provided. According to this configuration, it is possible to realize a lighter diaphragm and to improve electroacoustic conversion efficiency of the speaker device.

In the suspension 2 of Modification 1, the first holes 6 (and the second holes 7) are not provided at even intervals. The first holes 6 (and the second holes 7) are dense in central parts of the curved parts of the suspension 2. By thus concentrating holes in parts where the suspension 2 needs to be stretched and compressed more during vibration of the vibrator 1, it is possible to improve the linearity of the supporting force of the suspension 2 for supporting the vibrator 1.

In Modification 2 illustrated in FIG. 6B, a speaker diaphragm is constituted by a circular vibrator 1 and a circular suspension 2. A similar configuration can also be employed for such a circular speaker diaphragm.

In Modification 3 illustrated in FIG. 6C, a speaker diaphragm constituted by a circular vibrator 1 and a circular suspension 2 is designed so that first holes 6 (and second holes 7) are disposed in another way. Specifically, slit-like first holes 6 (and second holes 7) are formed at a predetermined angle θ with respect to a straight line passing the center of the speaker diaphragm, in other words, a normal to the inner peripheral part 2*b* of the suspension 2. Accordingly, the length of the first holes 6 (and the second holes 7) can be made longer than the width (roll width) from the inner peripheral part 2*b* to the outer peripheral part 2*a* of the suspension 2. This allows a stress to become force in a rotational direction, and therefore the stress is mitigated. Therefore, the vibrator 1 can more smoothly vibrate.

In Modification 4 illustrated in FIG. 6D, a speaker diaphragm constituted by a circular vibrator 1 and a circular suspension 2 is designed so that first holes 6 (and second holes 7) are disposed in still another way. Specifically, a plurality of small holes are provided in a direction from the inner peripheral part 2*b* toward the outer peripheral part 2*a* of the suspension 2.

Figure 7A:
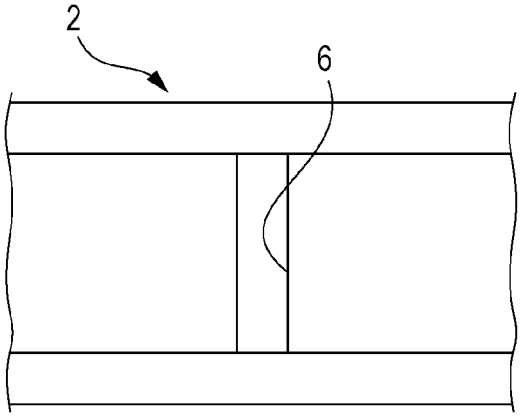
FIG. 7A is a diagram illustrating a modification of slit-like holes provided in a suspension.
Figure 7B:
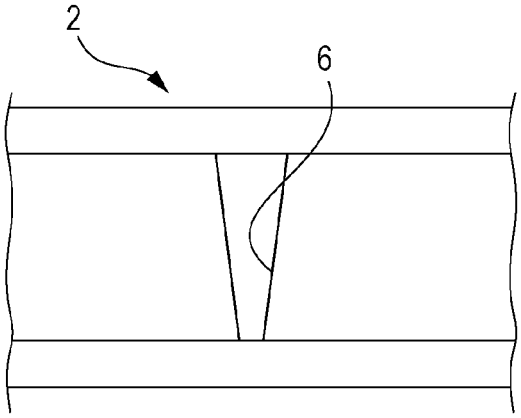
FIG. 7B is a diagram illustrating a modification of slit-like holes provided in a suspension.
Figure 7C:
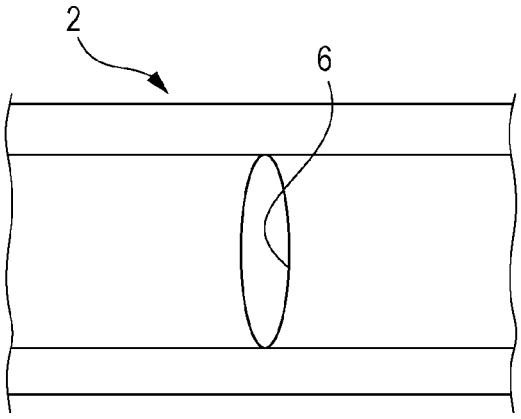
FIG. 7C is a diagram illustrating a modification of slit-like holes provided in a suspension.
Figure 7D:
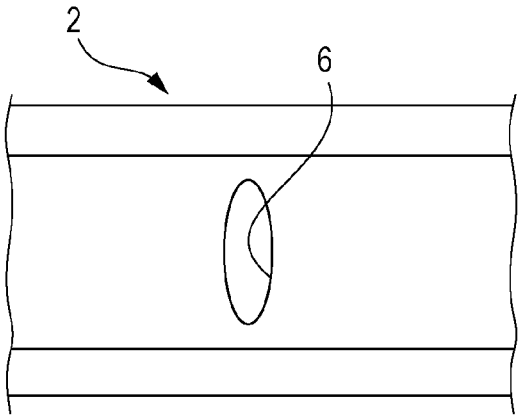
FIG. 7D is a diagram illustrating a modification of slit-like holes provided in a suspension.
Figure 7E:
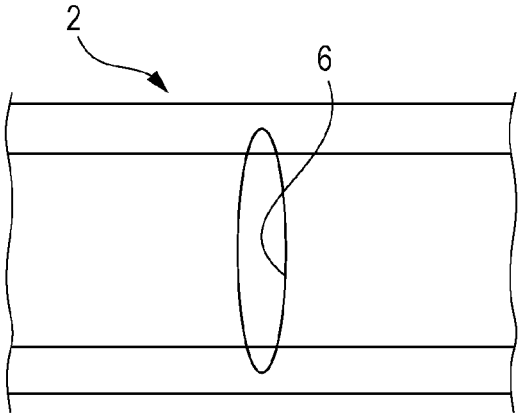
FIG. 7E is a diagram illustrating a modification of slit-like holes provided in a suspension.
Figure 7F:
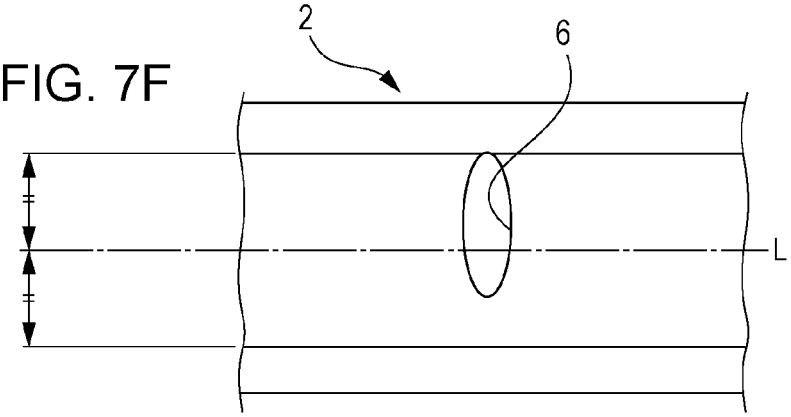
FIG. 7F is a diagram illustrating a modification of slit-like holes provided in a suspension.

FIGS. 7A through 7F are diagrams illustrating modifications of the slit-like first holes 6 (and the second holes 7). The shape of the first holes 6 (and the second holes 7) may be a rectangular shape constituted by parallel lines (FIG. 7A), a shape that widens from the inner peripheral part 2*b* toward the outer peripheral part 2*a* of the suspension 2 (FIG. 7B), or any curved shape or elliptic shape (FIG. 7C). Furthermore, the size of the first holes 6 (and the second holes 7) may be smaller than the roll width (FIG. 7D) or may be larger than the roll width (FIG. 7E). The position of the center of each of the first holes 6 (and the second holes 7) may be deviated from a central line L of the roll width of the suspension 2 (FIG. 7F). In this case, the linearity of the supporting force of the suspension 2 for supporting the vibrator 1 can be adjusted by changing the position and shape of the holes. It is therefore possible to realize a diaphragm having better linearity.

Other Embodiments

Speaker Using Speaker Diaphragm

Figure 8A:
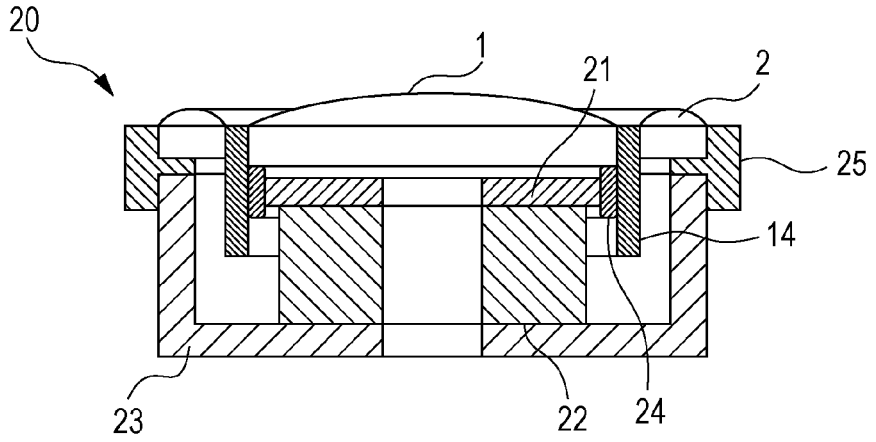
FIG. 8A is a diagram illustrating an example of a speaker using the speaker diaphragm according to the present embodiment.

FIG. 8A is a cross-sectional view of a speaker 20 using a speaker diaphragm according to the present embodiment described above. The speaker 20 includes a plate 21, a magnet 22, and a yoke 23 that constitute a magnetic circuit. A voice coil 14 is disposed in a formed magnetic gap. The voice coil 14 is adhered to the vibrator 1 of the speaker diaphragm, and the suspension 2 is adhered to a frame 25. When an electrical signal is applied to the voice coil 14, the diaphragm vibrates, and thus sound is reproduced. When the rigidity of the suspension 2 decreases, the diaphragm is more likely to vibrate in directions other than a normal vibration direction (i.e., so-called rolling vibration). To suppress this rolling vibration, a magnetic fluid 24 is disposed in the magnetic circuit. This prevents the rolling vibration. Furthermore, the magnetic fluid 24 has an effect of releasing heat of the voice coil 14 to the plate 21 (or the yoke 23) and an effect of improving input resistance. If these effects are not expected, the magnetic fluid 24 may be omitted.

According to the speaker having this structure, the linearity of the vibrator supporting force is better than that in a conventional art as described in the above embodiment, and it is possible to reduce the supporting force for supporting the vibrator 1. It is therefore possible to realize a speaker that is capable of reproducing low pitch sound with low distortion.

Figure 8B:
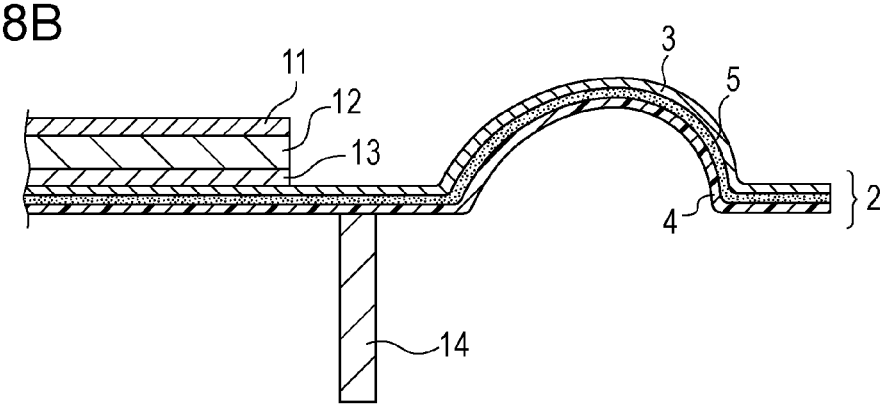
FIG. 8B is a diagram illustrating an example of a speaker using the speaker diaphragm according to the present embodiment.
Figure 8C:
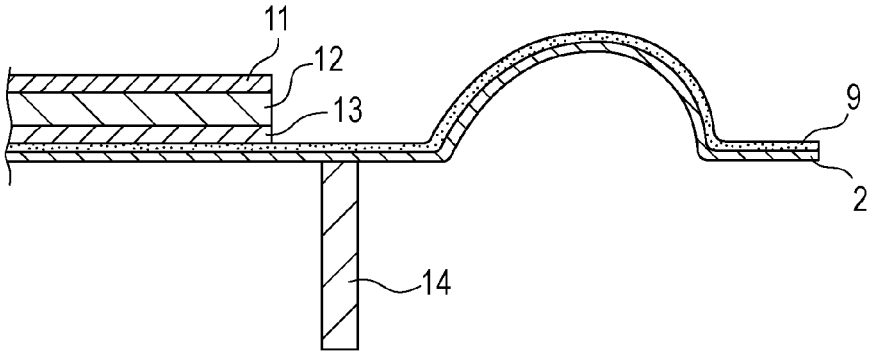
FIG. 8C is a diagram illustrating an example of a speaker using the speaker diaphragm according to the present embodiment.

Note that the speaker 20 may also be configured as illustrated in FIGS. 8B and 8C. FIG. 8B is a diagram illustrating an example of a speaker using the speaker diaphragm according to the present embodiment, specifically a cross-sectional view of a speaker using the speaker diaphragm according to the First Embodiment. In FIG. 8B, the configuration of the suspension 2 is, for example, identical to that described in the First Embodiment with reference to FIGS. 1A through 1D and is not described in detail below.

In FIG. 8B, a top surface member 3 serves as part of a vibrator 1. The vibrator 1 includes a top surface material 11, an intermediate material 12, and a rear surface material 13 that constitute a honeycomb structure adhered on the top surface member 3. According to the configuration of FIG. 8A, the voice coil 14 is directly adhered on the vibrator 1, and therefore the position of the voice coil 14 in the magnetic gap is fixed to some extent. However, according to the configuration of FIG. 8B, the voice coil 14 can be disposed at a position where a magnetic flux is largest in the magnetic circuit due to a rear surface member 4 without the need to provide a voice coil bobbin. This makes it possible to maximize driving force while suppressing an increase in the mass. It is therefore possible to realize a speaker that has higher efficiency. Furthermore, since the vibrator 1 has a honeycomb structure sandwiched by two plates, the vibrator 1 can have high a rigidity even if the vibrator 1 is provided in a small speaker in which the height of the vibrator 1 is restricted. It is therefore possible to realize a light speaker having good high-frequency characteristics.

FIG. 8C is a diagram illustrating an example of a speaker using the speaker diaphragm according to the present embodiment, specifically a cross-sectional view of a speaker using the speaker diaphragm according to the Second Embodiment. In FIG. 8C, the configurations of the suspension 2 and the sealing member 9 are, for example, identical to those described in the Second Embodiment with reference to FIGS. 4A through 4H and are not described in detail below.

Needless to say, a speaker may be realized by using the speaker diaphragm of Second Embodiment.

Device in which Speaker is Provided

Figure 9:
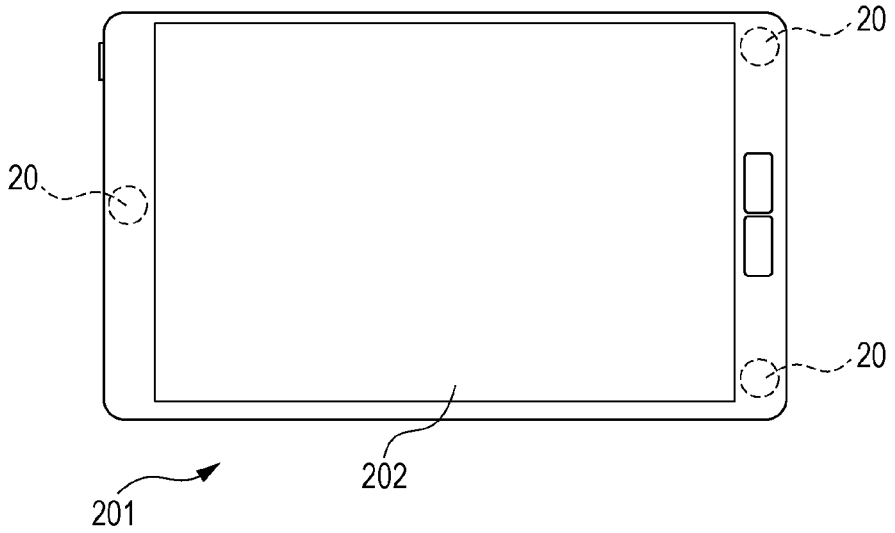
FIG. 9 is a diagram illustrating an example of a device in which a speaker using the speaker diaphragm according to the present embodiment is mounted.

FIG. 9 is a diagram illustrating a tablet terminal 201 in which a speaker 20 using the speaker diaphragm according to the present embodiment is provided. In recent years, in a mobile terminal such as the tablet terminal 201, the position of a speaker is provided on an end of the terminal due to a reduction in the size and thickness of a chassis and an increase in the size of a display 202. Accordingly, there are demands for a reduction in the size of a speaker. Meanwhile, there is a demand for an improvement of sound quality as a result of enhancement of screen resolution. Use of the speaker 20 using the speaker diaphragm according to the present embodiment makes it possible to realize a small tablet terminal 201 that is capable of providing low pitch sound with low distortion.

Figure 10:
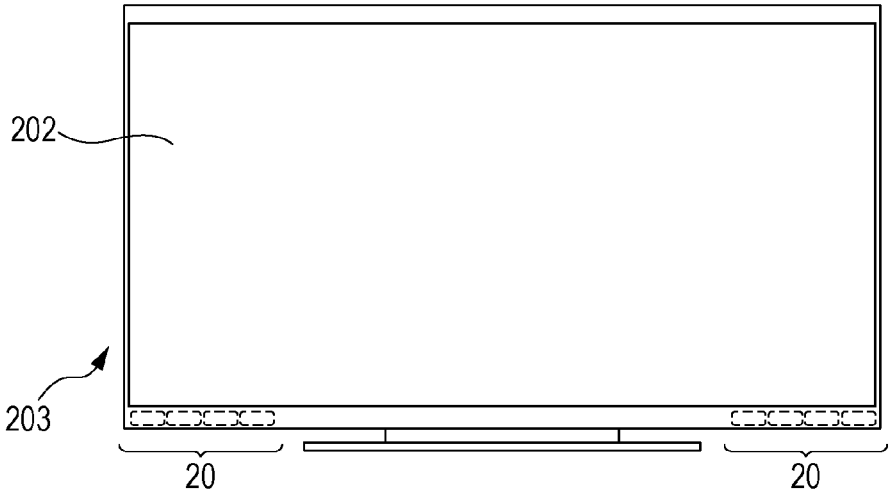
FIG. 10 is a diagram illustrating an example of a device in which a speaker using the speaker diaphragm according to the present embodiment is mounted.

FIG. 10 is a diagram illustrating an image display device 203 in which a speaker 20 using the speaker diaphragm according to the present embodiment is mounted. More specifically, the image display device 203 is, for example, a display for a PC, a television, or the like. In recent years, the image display device 203 is required to reproduce high-quality sound along with an increase in the size and enhancement of resolution of a display 202. Meanwhile, there are demands for a slim-shape speaker in response to demands for "narrow bezel" design (i.e., a frame that surrounds a screen is narrow). In view of this, a plurality of small speakers 20 using the speaker diaphragm according to the present embodiment are disposed in a narrow bezel. According to a conventional slim-shape speaker in which a sufficient width of the suspension 2 cannot be secured, reproduction of low pitch sound is insufficient. However, the small speakers 20 using the speaker diaphragm according to the present embodiment is capable of reproducing low pitch sound with low distortion. Therefore, it is possible to provide high-quality sound even if the "narrow bezel design" is adopted.

Figure 11:
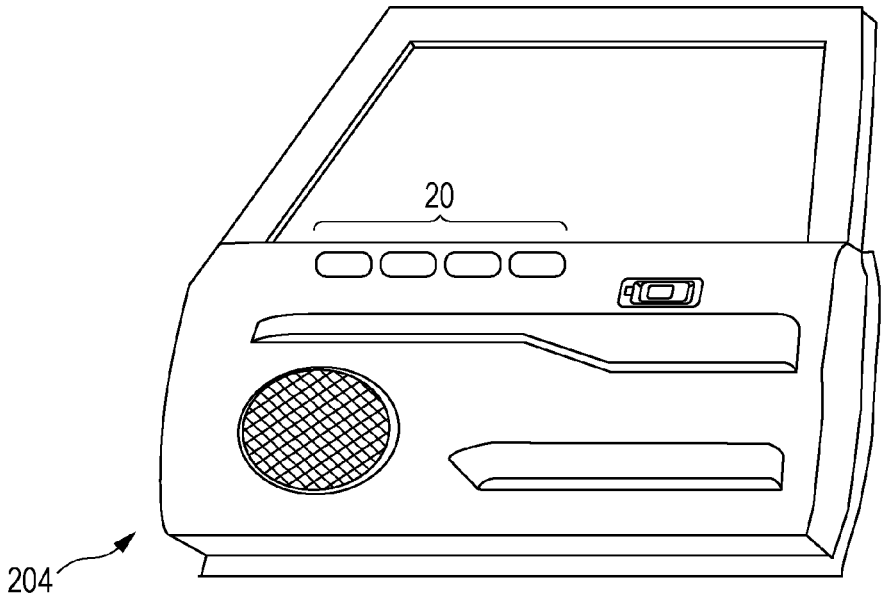
FIG. 11 is a diagram illustrating an example of a device in which a speaker using the speaker diaphragm according to the present embodiment is mounted.

FIG. 11 is a diagram illustrating a vehicle door 204 in which a speaker 20 using the speaker diaphragm according to the present embodiment is mounted. Conventionally, an on-board speaker puts a high priority on low pitch sound reproduction capability, and therefore has a large size and can be disposed only in a restricted area of the vehicle. However, according to the speaker 20 using the speaker diaphragm according to the present embodiment, it is possible to reproduce low pitch sound with low distortion even if the size of the speaker 20 is small. It is therefore possible to dispose the speaker 20 in the vicinity of a window frame of the vehicle door 204 unlike a conventional art. Note that the position of the speaker 20 is not limited to the window frame illustrated in FIG. 11, and the speaker 20 may be provided on a ceiling, a dashboard, a front panel, a pillar, a head rest, a handle, or the like of the vehicle.

Figure 12:
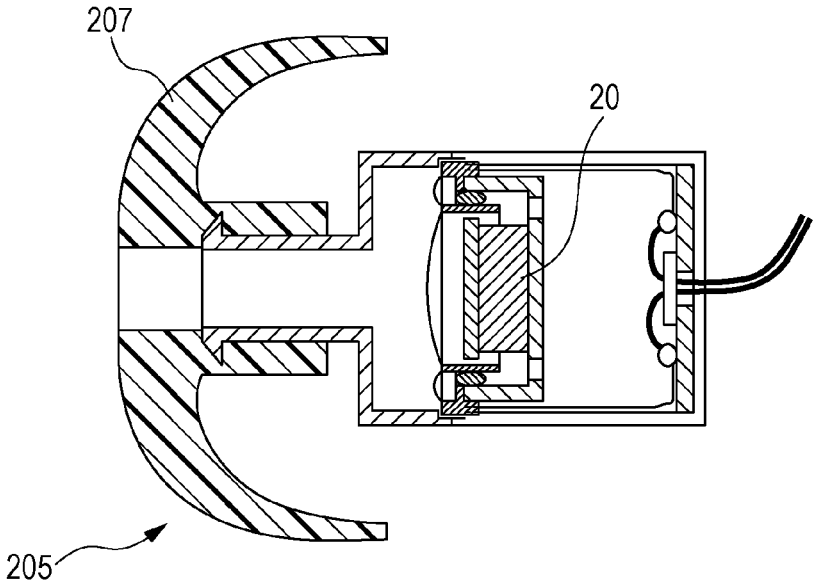
FIG. 12 is a diagram illustrating an example of a device in which a speaker using the speaker diaphragm according to the present embodiment is mounted.

FIG. 12 is a diagram illustrating an in-ear earphone 205 in which a speaker 20 using the speaker diaphragm according to the present embodiment is mounted. The in-ear earphone 205 is required to be a small, light, and high-power earphone so that the in-ear earphone 205 feels more fitted in ears. Furthermore, if air leaks from a contact surface between an ear coupler 207 and the inside of the ears, low pitch sound reproduction capability of the in-ear earphone 205 decreases. Therefore, the speaker 20 is required to have a higher low pitch sound reproduction capability. Since the speaker 20 using the speaker diaphragm according to the present embodiment is capable of reproducing low pitch sound with low distortion even if the size of the speaker 20 is small, it is possible to provide a small in-ear earphone 205 that achieves high-quality sound and that feels fitted. Note that although the in-ear earphone 205 that is inserted into an ear is illustrated in FIG. 12, the speaker 20 may be mounted in an on-ear type headphone attached on an ear or an ear-cover type headphone attached to cover an ear. The present disclosure is useful for a speaker diaphragm, a speaker including a speaker diaphragm, a device including a speaker, and a method for manufacturing a speaker diaphragm.

The speaker diaphragm according to the present disclosure has high linearity and high compliance and is useful for a speaker, especially a small speaker that reproduces low pitch sound. Furthermore, the speaker diaphragm according to the present disclosure is applicable to a video audio device including the speaker (a video display appliance, an audio appliance, an in-ear headphone, a home electrical appliance, and the like), a mobile information processing device (a mobile phone, a smartphone, a tablet PC, an operation terminal, and the like), and a moving device (an automobile, a railroad, and the like).

What is claimed is:

1. A speaker diaphragm comprising:

a vibrator; and a suspension that is adhered to an outer peripheral part of the vibrator and supports the vibrator so that the vibrator is capable of vibrating, wherein at least part of the suspension includes a top surface member that constitutes a top surface part of the suspension, a rear surface member that constitutes a rear surface part of the suspension, and an intermediate member disposed between the top surface member and the rear surface member, the top surface member, the rear surface member, and the intermediate member being stacked on one another, a rigidity of the intermediate member is lower than that of at least one of the top surface member and the rear surface member, the top surface member has one or more first holes, the rear surface member has one or more second holes, and at least some of the one or more first holes and the one or more second holes are disposed so as to overlap each other across the intermediate member in a direction in which the top surface member, the rear surface member, and the intermediate member are stacked.

2. The speaker diaphragm according to claim 1, further comprising a sealing member that covers at least one of (i) the one or more first holes and (ii) the one or more second holes, a rigidity of the sealing member being lower than that of the intermediate member.

3. The speaker diaphragm according to claim 1, wherein at least one of the top surface member and the rear surface member is made of a resin film, solid rubber, foamed rubber, urethane, fabric or paper impregnated with a resin material or rubber, an adhesive material, or any combination thereof.

4. The speaker diaphragm according to claim 1, wherein the intermediate member is made of an adhesive material, an elastomer, a gel-like material, or a liquid.

5. The speaker diaphragm according to claim 1, wherein the suspension has a roll-shaped or bellows-shaped cross section.

6. The speaker diaphragm according to claim 1, wherein the one or more first holes and the one or more second holes are provided in the form of slits in a direction normal to the outer peripheral part of the vibrator.

7. The speaker diaphragm according to claim 6, wherein the one or more first holes and the one or more second holes are provided at a predetermined angle with respect to the direction normal to the outer peripheral part of the vibrator.

8. The speaker diaphragm according to claim 1, wherein the outer peripheral part of the vibrator has a circular shape, an elliptic shape, a polygonal shape, or a shape combining two or more straight lines and two or more curves.

9. The speaker diaphragm according to claim 1, wherein the outer peripheral part of the vibrator has a shape constituted by at least two straight lines and at least two curves.

10. The speaker diaphragm according to claim 9, wherein the one or more first holes and the one or more second holes are provided only in the curves.

11. The speaker diaphragm according to claim 10, wherein the first holes and the second holes are provided at uneven intervals.

12. The speaker diaphragm according to claim 1, wherein the intermediate member has, at positions where the one or more first holes and the one or more second holes are disposed, an opening whose area is smaller than at least one of (i) the one or more first holes and (ii) the one or more second holes.

13. A speaker comprising:

a speaker diaphragm including:

a vibrator; and a suspension that is adhered to an outer peripheral part of the vibrator and supports the vibrator so that the vibrator is capable of vibrating, wherein at least part of the suspension includes a top surface member that constitutes a top surface part of the suspension, a rear surface member that constitutes a rear surface part of the suspension, and an intermediate member disposed between the top surface member and the rear surface member, the top surface member, the rear surface member, and the intermediate member being stacked on one another, a rigidity of the intermediate member is lower than that of at least one of the top surface member and the rear surface member, the top surface member has one or more first holes, the rear surface member has one or more second holes, and at least some of the one or more first holes and the one or more second holes are disposed so as to overlap each other across the intermediate member in a direction in which the top surface member, the rear surface member, and the intermediate member are stacked.

14. A device comprising:

a speaker including a speaker diaphragm, wherein the speaker diaphragm includes:

a vibrator; and a suspension that is adhered to an outer peripheral part of the vibrator and supports the vibrator so that the vibrator is capable of vibrating, wherein at least part of the suspension includes a top surface member that constitutes a top surface part of the suspension, a rear surface member that constitutes a rear surface part of the suspension, and an intermediate member disposed between the top surface member and the rear surface member, the top surface member, the rear surface member, and the intermediate member being stacked on one another, a rigidity of the intermediate member is lower than that of at least one of the top surface member and the rear surface member, the top surface member has one or more first holes, the rear surface member has one or more second holes, and at least some of the one or more first holes and the one or more second holes are disposed so as to overlap each other across the intermediate member in a direction in which the top surface member, the rear surface member, and the intermediate member are stacked.

15. A method for manufacturing a speaker diaphragm including a vibrator and a suspension, comprising:

molding a top surface member, an intermediate member, and a rear surface member each having a planar shape into a specific shape that supports the vibrator so that the vibrator is capable of vibrating;

forming the one or more first holes in the top surface member that has been molded into the specific shape;

forming the one or more second holes in the rear surface member that has been molded into the specific shape; and stacking the top surface member in which the one or more first holes are formed, the intermediate member, and the rear surface member in which the one or more second holes are formed in this order so as to form the suspension of the speaker diaphragm.

16. The method according to claim 15, wherein the one or more first holes and the one or more second holes are formed by using laser light or a machine blade.

17. A method for manufacturing a speaker diaphragm including a vibrator and a suspension, the method comprising:

forming one or more first holes in a top surface member having a planar shape;

forming one or more second holes in a rear surface member having a planar shape;

stacking the top surface member in which the one or more first holes are formed, an intermediate member having a planar shape, and the rear surface member in which the one or more second holes are formed in this order; and molding the top surface member, the intermediate member, and the rear surface member that have been stacked on one another into a specific shape that supports the vibrator so that the vibrator is capable of vibrating so as to form the suspension of the speaker diaphragm.

18. A method for manufacturing a speaker diaphragm including a vibrator and a suspension, comprising:

molding a top surface member, an intermediate member, and a rear surface member each having a planar shape into a specific shape that supports the vibrator so that the vibrator is capable of vibrating;

stacking the top surface member, the intermediate member, and the rear surface member that have been molded into the specific shape in this order; and forming the one or more first holes in the top surface member and forming the one or more second holes in the rear surface member by using a half-cut method so as to form the suspension of the speaker diaphragm.

19. A speaker diaphragm comprising:

a vibrator;

a suspension that is adhered to an outer peripheral part of the vibrator, supports the vibrator so that the vibrator is capable of vibrating, and has one or more holes; and a sealing member that covers the one or more holes and has a rigidity lower than that of the suspension, wherein the sealing member is adhered to both a top surface of the suspension and side surfaces of the one or more holes.

20. The speaker diaphragm according to claim 19, wherein the sealing member is also adhered to a rear surface of the suspension.

21. The speaker diaphragm according to claim 19, wherein the suspension is made of a resin film, solid rubber, foamed rubber, urethane, fabric or paper impregnated with a resin material or rubber, an adhesive material, or any combination thereof.

22. The speaker diaphragm according to claim 19, wherein the sealing member is made of an adhesive material, an elastomer, a gel-like material, or any combination thereof.

23. The speaker diaphragm according to claim 19, wherein the suspension has a roll-shaped or bellows-shaped cross section.

24. The speaker diaphragm according to claim 19, wherein the one or more holes are provided in the form of slits in a direction normal to the outer peripheral part of the vibrator.

25. The speaker diaphragm according to claim 19, wherein the one or more holes are provided at a predetermined angle with respect to a direction normal to the outer peripheral part of the vibrator.

26. The speaker diaphragm according to claim 19, wherein the outer peripheral part of the vibrator has a circular shape, an elliptic shape, a polygonal shape, or a shape combining two or more straight lines and two or more curves.

27. The speaker diaphragm according to claim 19, wherein the outer peripheral part of the vibrator has a shape constituted by at least two straight lines and at least two curves.

28. The speaker diaphragm according to claim 27, wherein the one or more holes are provided only in the curves.

29. The speaker diaphragm according to claim 28, wherein the holes are provided at uneven intervals.

30. A speaker comprising a speaker diaphragm:

the speaker diaphragm including:

a vibrator;

a suspension that is adhered to an outer peripheral part of the vibrator, supports the vibrator so that the vibrator is capable of vibrating, and has one or more holes; and a sealing member that covers the one or more holes and has rigidity lower than that of the suspension, wherein the sealing member is adhered to both a top surface of the suspension and side surfaces of the one or more holes.

31. A device comprising a speaker including a speaker diaphragm, the speaker diaphragm including:

a vibrator;

a suspension that is adhered to an outer peripheral part of the vibrator, supports the vibrator so that the vibrator is capable of vibrating, and has one or more holes; and a sealing member that covers the one or more holes and has a rigidity lower than that of the suspension, wherein the sealing member is adhered to both a top surface of the suspension and side surfaces of the one or more holes.

32. A method for manufacturing a speaker diaphragm including a vibrator and a suspension, comprising:

molding a member having a planar shape into a specific shape that supports the vibrator so that the vibrator is capable of vibrating;

forming one or more holes in the member that has been molded into the specific shape and covering the one or more holes formed in the member with a sealing member so as to form the suspension of the speaker diaphragm.

33. A method for manufacturing a speaker diaphragm including a vibrator and a suspension, comprising:

forming one or more holes in member having a planar shape;

covering the one or more holes formed in the member with a sealing member; and molding the member whose holes are covered with the sealing member into a specific shape that supports the vibrator so that the vibrator is capable of vibrating so as to form the suspension of the speaker diaphragm.

* * * * *